US012723347B2

(12) United States Patent
Takeshita

(10) Patent No.: US 12,723,347 B2
(45) Date of Patent: Sep. 1, 2026

(54) SYNTHETIC LEATHER AND SKIN MATERIAL

(71) Applicant: SEIREN CO., LTD., Fukui (JP)

(72) Inventor: Kyosuke Takeshita, Fukui (JP)

(73) Assignee: SEIREN CO., LTD., Fukui (JP)

( * ) Notice: Subject to any disclaimer, the term of this patent is extended or adjusted under 35 U.S.C. 154(b) by 148 days.

(21) Appl. No.: 18/689,138

(22) PCT Filed: Oct. 3, 2022

(86) PCT No.: PCT/JP2022/036937

§ 371 (c)(1),
(2) Date: Mar. 5, 2024

(87) PCT Pub. No.: WO2023/058596

PCT Pub. Date: Apr. 13, 2023

(65) Prior Publication Data

US 2024/0376666 A1 Nov. 14, 2024

(30) Foreign Application Priority Data

Oct. 8, 2021 (JP) ..... 2021-166245

(51) Int. Cl.
*D06N 3/00* (2006.01)

(52) U.S. Cl.
CPC ..... *D06N 3/0043* (2013.01); *D06N 2211/28* (2013.01)

(58) Field of Classification Search
CPC ..... D06N 3/0043
USPC ..... 428/409
See application file for complete search history.

(56) References Cited

U.S. PATENT DOCUMENTS

| | | | |
|---|---|---|---|
| 2009/0311480 | A1 | 12/2009 | Fischer et al. |
| 2016/0298291 | A1 | 10/2016 | Yoshida |
| 2022/0220667 | A1 | 7/2022 | Ito |

FOREIGN PATENT DOCUMENTS

| | | | | |
|---|---|---|---|---|
| JP | H02061181 | A | | 3/1990 |
| JP | H02307987 | A | | 12/1990 |
| JP | H06192966 | A | | 7/1994 |
| JP | 2003293270 | A | | 10/2003 |
| JP | 201169031 | A | | 4/2011 |
| JP | 201376173 | A | | 4/2013 |
| JP | 2015104848 | A | | 6/2015 |
| JP | 2015123597 | A | | 7/2015 |
| JP | 2016147466 | A | * | 8/2016 |
| JP | 2018053411 | A | | 4/2018 |

(Continued)

OTHER PUBLICATIONS

Machine_english_translation_JP_2016147466_A; Yoshimura et al.; Skin Material for Vehicle Interior; Aug. 18, 2016; EPO; whole document (Year: 2025).*

(Continued)

*Primary Examiner* — Tahseen Khan
(74) *Attorney, Agent, or Firm* — Lerner David LLP

(57) ABSTRACT

A synthetic leather includes a fibrous base material and a porous resin layer. The porous resin layer is laminated on the fibrous base material. The porous resin layer has a plurality of holes. The porous resin layer contains a plurality of hollow particles in a resin serving as a base material of the porous resin layer. The plurality of hollow particles is dispersed in the resin serving as the base material of the porous resin layer. The hollow particle has the hole inside.

10 Claims, 6 Drawing Sheets

(56) References Cited

FOREIGN PATENT DOCUMENTS

| | | | |
|---|---|---|---|
| KR | 20200131773 | A | 11/2020 |
| KR | 20200131774 | A | 11/2020 |
| WO | 2015098032 | A1 | 7/2015 |
| WO | 2020261785 | A1 | 12/2020 |

OTHER PUBLICATIONS

Extended European Search Report including Written Opinion for Application No. 22878465.8 dated Sep. 22, 2025 . 8 pgs.
International Search Report for Application No. PCT/JP2022/036937 mailed Dec. 6, 2022, pp. 1-4.
Search Report dated Mar. 23, 2026 from the Office Action for Chinese Application No. 202280052537.5 issued Mar. 25, 2026, pp. 1-3.

* cited by examiner

SYNTHETIC LEATHER (10) OF SAMPLE 1 (BEFORE EMBOSSING)

SKIN MATERIAL (70) OF SAMPLE 1

SYNTHETIC LEATHER AND SKIN MATERIAL

CROSS-REFERENCE TO RELATED APPLICATIONS

This application is a national phase entry under 35 U.S.C. § 371 of International Application No. PCT/JP2022/036937 filed Oct. 3, 2022, which claims priority from Japanese Patent Application No. 2021-166245 filed in the Japanese Patent Office on Oct. 8, 2021, the entire contents of which are hereby incorporated by reference herein.

TECHNICAL FIELD

The present invention relates to a synthetic leather and a skin material having a concavo-convex pattern on a surface of the synthetic leather.

BACKGROUND ART

Techniques related to a synthetic leather forming a skin material have been proposed. Patent Document 1 discloses a leather-like sheet. In the leather-like sheet, a surface layer and a finishing layer are laminated on at least one side of a fibrous base layer. The surface layer is porous or non-porous which is constructed of a polymer. This polymer is mainly constructed of polyurethane having a softening molding temperature of 130 to 185° C. The finishing layer is non-porous of the polymer. This polymer has a softening molding temperature at least 30° C. higher than the polyurethane of the surface layer. The finishing layer includes a coloring agent. The surface layer constructs an intermediate portion between the fibrous base layer and the finishing layer. According to the leather-like sheet, it is possible to reduce a deformation of the base layer and form a sharp shape.

Patent Document 2 discloses a leather-like sheet. In the leather-like sheet, a surface finishing layer, a surface porous layer, and a fibrous base layer are laminated in this order from the surface. The fibrous base layer includes a upper layer and a lower layer. In the fibrous base layer, elastic resin is filled into intertwined spaces of a three-dimensionally entangled nonwoven fabric. The elastic resin is mainly constructed of polyurethane. The surface porous layer is in close contact with the surface of the fibrous base layer. The surface porous layer is formed by polyurethane resin. In the leather-like sheet, the ratio of a first apparent density (A) of the surface porous layer and a second apparent density (B) of the upper layer portion of the fibrous base layer is "A/B<1". The leather-like sheet has an elegant natural leather-like appearance, excellent flexibility, and high peel strength.

The applicant discloses a skin material for vehicle interiors in Patent Document 3, and discloses a skin material in Patent Document 4.

CITATION LIST

Patent Literature

Patent Document 1: JPA No. H02-61181
Patent Document 2: JPA No. 2003-293270
Patent Document 3: JPA No. 2016-147466
Patent Document 4: JPA No. 2015-104848

SUMMARY OF THE INVENTION

Problems to be Solved by the Invention

A skin material is provided on a front side of a predetermined product and forms a front face of this product. The skin material is required to have design properties. The inventor considered that by providing a concavo-convex pattern on a front face of a synthetic leather, it would be possible to realize the skin material having design properties. At that time, the inventor considered embossing to be a preferable method for forming the concavo-convex pattern. For example, embossing has excellent productivity. Furthermore, the inventor considered that it is important to make boundary lines of the concavo-convex pattern in a sharp shape in order to improve the design properties of the skin material. The "boundary line" corresponds to the following portion within the concavo-convex pattern. The previously-mentioned portion is formed by two non-parallel surfaces contacting each other and has an angular shape. The inventor studied a structure of the synthetic leather that allows the boundary lines of the concavo-convex pattern to have a sharp shape. At that time, the inventor considered embossing as a method for forming the concavo-convex pattern.

An object of the present invention is to provide a synthetic leather that can have the boundary lines of the concavo-convex pattern in a sharp shape. Another object of the present invention is to provide a skin material having the concavo-convex pattern with sharp shaped boundary lines.

Solutions to Problems

One aspect of the present invention is a synthetic leather including: a fibrous base material, and a porous resin layer laminated on the fibrous base material, and having a plurality of holes, wherein the porous resin layer contains a plurality of hollow particles in a resin serving as a base material of the porous resin layer, wherein the plurality of hollow particles is dispersed in the resin, wherein the hollow particle has the hole inside.

According to this synthetic leather, the sizes of the plurality of holes formed inside the plurality of hollow particles can be made uniform. When embossing the synthetic leather, the area in which the plurality of hollow particles is dispersed in the porous resin layer can be uniformly deformed.

The porous resin layer may include: a first porous resin layer laminated on the fibrous base material; and a second porous resin layer laminated on the first porous resin layer, wherein the first porous resin layer may have a plurality of first holes which is a part of the plurality of holes, wherein the second porous resin layer may have a plurality of second holes which is a part of the plurality of holes, wherein the plurality of hollow particles may be dispersed in a resin serving as a base material of the second porous resin layer, wherein the hollow particle may have the second hole inside.

According to this structure, the sizes of the plurality of second holes can be made uniform. The plurality of second holes of uniform size can be dispersed in the second porous resin layer laminated on the first porous resin layer. When embossing the synthetic leather, the second porous resin layer can be uniformly deformed.

The first hole may be a closed space having a long diameter of a first dimension, wherein the second hole may be a closed space having a long diameter of a second dimension smaller than the first dimension. Further, a softening temperature of the first porous resin layer may be a first temperature, wherein a softening temperature of the second porous resin layer may be a second temperature lower than the first temperature.

According to these structures, when embossing the synthetic leather, the second porous resin layer can be more easily deformed than the first porous resin layer.

Another aspect of the present invention is a skin material including: any of the above-described synthetic leathers, wherein the synthetic leather has concavo-convex pattern on a front face.

According to this skin material, the synthetic leather exhibits the above-described functions when embossing.

Advanced Effects of the Invention

According to the present invention, it is possible to obtain the synthetic leather that can have the boundary lines of the concavo-convex pattern in a sharp shape. According to the present invention, it is possible to obtain a skin material having the concavo-convex pattern with sharp shaped boundary lines.

BRIEF DESCRIPTION OF THE DRAWINGS

FIG. 2 shows the synthetic leather of FIG. 1 after embossing.

FIG. 6 shows the synthetic leather of FIG. 5 after embossing.

DESCRIPTION OF EMBODIMENTS

Figure 1:
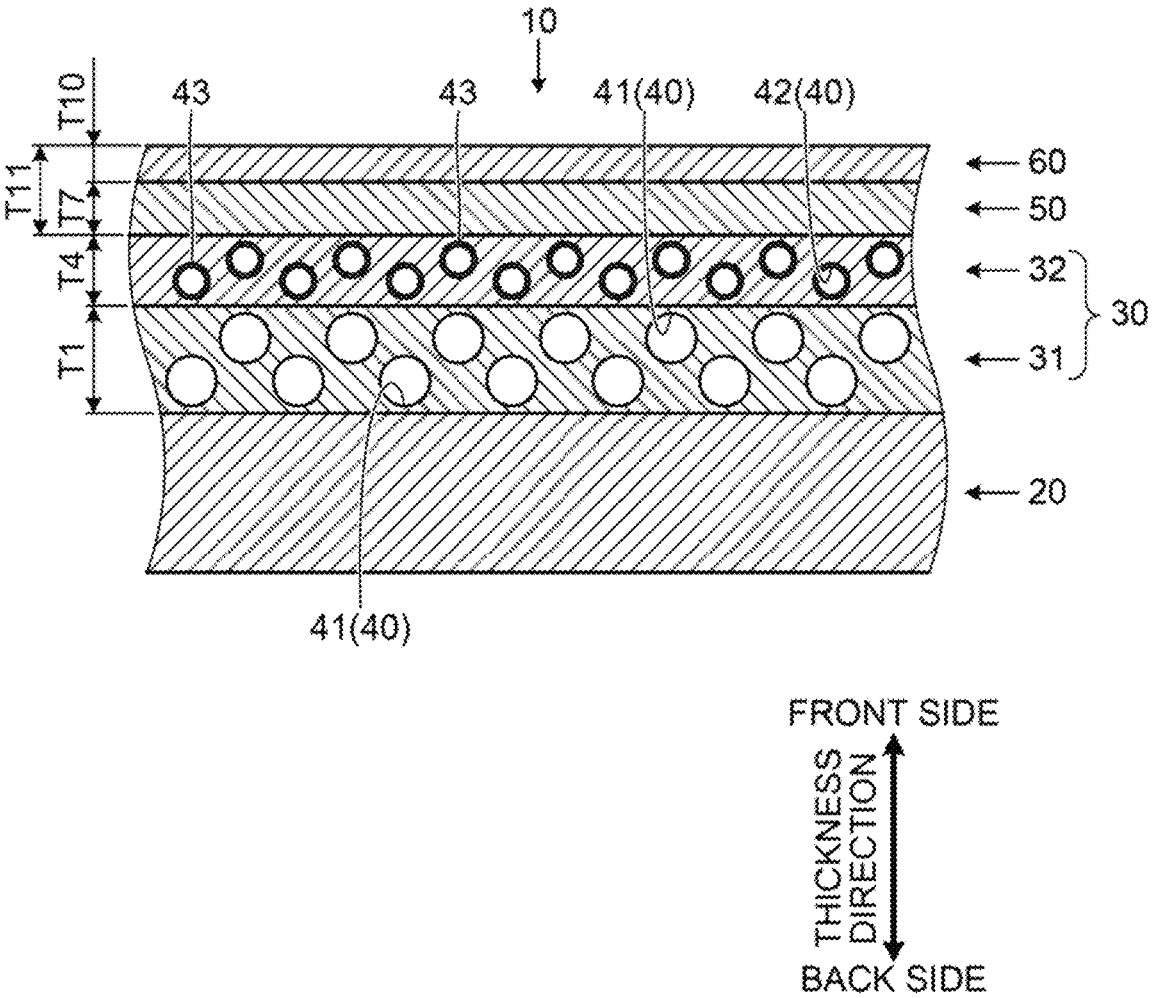
FIG. 1 is a cross-sectional view showing an example of a schematic structure of a synthetic leather. The synthetic leather shows a state before embossing.

Embodiments for carrying out the present invention will be described with reference to the drawings. The present invention is not limited to the configurations described below, and various configurations can be adopted based on the same technical idea. For example, a part of the configurations shown below may be omitted or may be replaced by another configuration. The present invention may include another configuration. The drawings schematically show a predetermined configuration. In each drawing, correspondence with other drawings, correspondence with a numerical value which will be described later specifying the configuration in the drawing or the magnitude relationship between configurations to be compared may not be accurate in some cases. Hatching indicates a cut surface.

<Synthetic Leather 10 and Skin Material 70>

Synthetic leather 10 and skin material 70 will be explained with reference to FIGS. 1 and 2. The synthetic leather 10 includes a fibrous base material 20, a porous resin layer 30, a non-porous resin layer 50, and a protective layer 60 (see FIG. 1). The porous resin layer 30 includes a first porous resin layer 31 and a second porous resin layer 32. In addition, the synthetic leather 10 may include a layer different from the porous resin layer 30 (the first porous resin layer 31 and the second porous resin layer 32), the non-porous resin layer 50, and the protective layer 60. An example of this different layer includes an adhesive layer.

Figure 2:
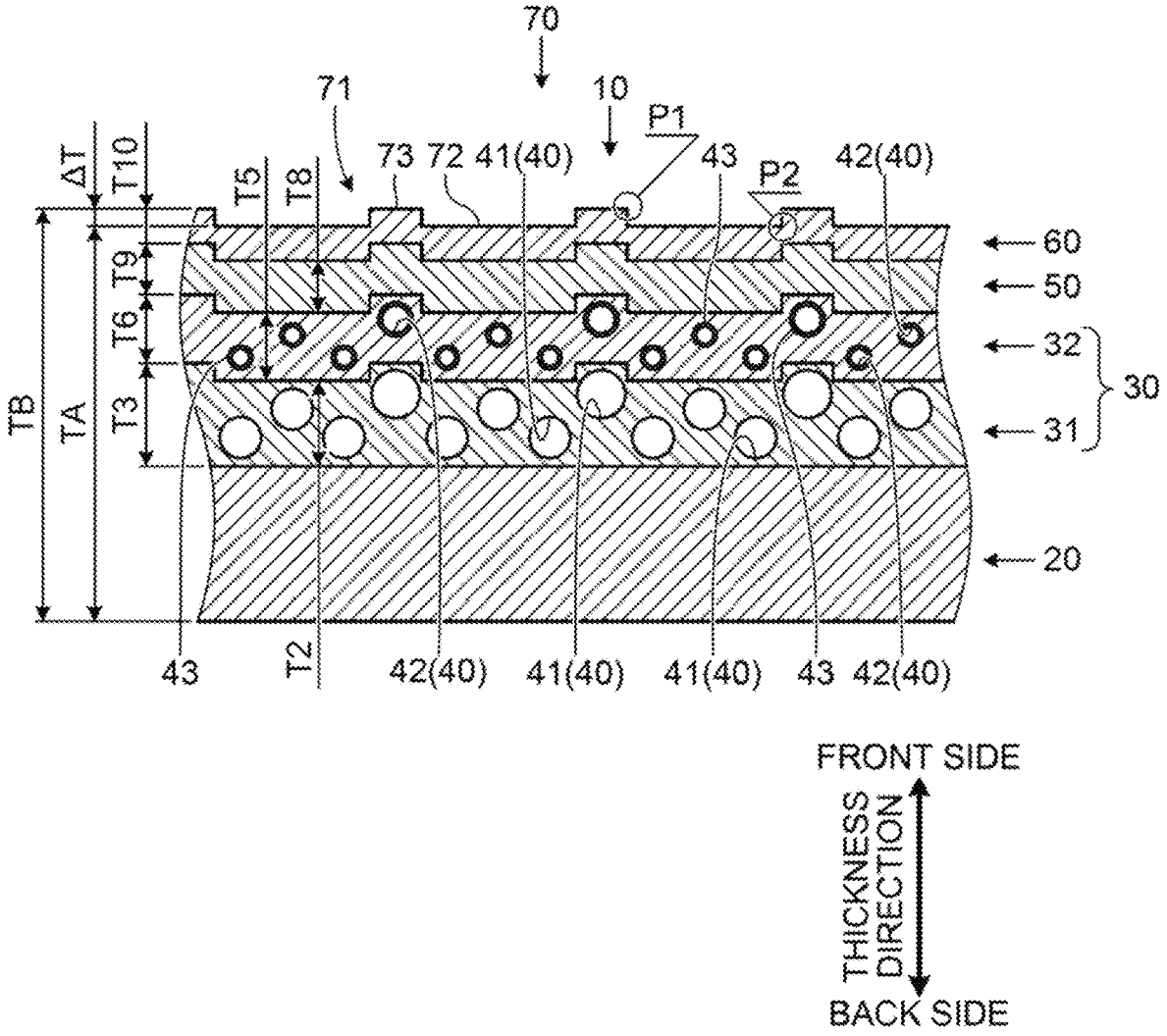
FIG. 2 is a cross-sectional view showing an example of a schematic structure of a skin material.

The synthetic leather 10 forms the skin material 70 (see FIG. 2). That is, the skin material 70 includes the synthetic leather 10. The skin material 70 is formed by embossing the synthetic leather 10. The synthetic leather 10 has a concavo-convex pattern 71 on its front face in the state of the skin material 70.

The skin material 70 can be used as an outer material for various products and parts. Examples of products and parts that can adopt the skin material 70 include transportation equipment interior parts, interior goods, shoes, bags, and clothing. The transportation equipment includes automobiles, trains, aircraft, and ships. When the skin material 70 is adopted as the interior part of the transportation equipment, the skin material 70 becomes a material forming the following portion of the transportation equipment. Examples of the previously mentioned portions include ceilings, seats, dashboards, door linings and handles. The interior goods include furniture. Examples of furniture include sofas and chairs.

In the embodiment, thickness direction of the synthetic leather 10, the fibrous base material 20, the porous resin layer 30, the non-porous resin layer 50, the protective layer 60, and the skin material 70 is referred to as a "thickness direction" (see FIGS. 1 and 2). One side in the thickness direction is referred to as a "front side" and the other side in the thickness direction is referred to as a "back side". The surface on the front side in the thickness direction is referred to as a "front face", and the surface on the back side in the thickness direction is referred to as a "back face". The front face of the synthetic leather 10 is the front face of the skin material 70, and the back face of the synthetic leather 10 is the back face of the skin material 70.

In the synthetic leather 10, the fibrous base material 20, the porous resin layer 30, the non-porous resin layer 50, and the protective layer 60 are laminated in the order of the protective layer 60, the non-porous resin layer 50, the porous resin layer 30, and the fibrous base material 20 from the front side to the back side in the thickness direction. In the porous resin layer 30, the first porous resin layer 31 and the second porous resin layer 32 are laminated in the order of the second porous resin layer 32, and the first porous resin layer 31 from the front side to the back side in the thickness direction. That is, the porous resin layer 30 is laminated on the fibrous base material 20. In this case, the first porous resin layer 31 is laminated on the fibrous base material 20, and the second porous resin layer 32 is laminated on the first porous resin layer 31. The non-porous resin layer 50 is laminated on the porous resin layer 30 (the second porous resin layer 32). The protective layer 60 is laminated on the non-porous resin layer 50. The front face of the protective layer 60 forms the front face of the synthetic leather 10 and the front face of the skin material 70. The back face of the fibrous base material 20 forms the back face of the synthetic leather 10 and the back face of the skin material 70.

The fibrous base material 20 is a fibrous sheet material. Examples of the fibrous base material 20 include fiber fabrics and a natural leather. Examples of the fiber fabrics include a woven fabric, a knitted fabric, and a non-woven fabric. The natural leather includes split leather. However, from the viewpoint of the texture of the synthetic leather 10, the fibrous base material 20 is preferably a woven fabric or a knitted fabric, and more preferably a knitted fabric. "Texture" means the feeling of holding an object in the hand. "Texture" is distinguished from "tactile feeling". "Tactile feeling" means the surface tactile feeling of an object. The fiber fabric may be coated or impregnated with a solvent-based or a solvent-free type polymer compound, or may be dry-coagulated or wet-coagulated with a solvent-based or a solvent-free type polymer compound. The solvent-free type includes a water-based type. Examples of polymer compounds include polyurethane resins and polyvinyl chloride resins. The density of the fibrous base material 20 is preferably from 0.01 to 0.05 $g/m^3$, and more preferably from 0.02 to 0.04 $g/m^3$.

The fiber forming the fiber fabric as the fibrous base material 20 is not particularly limited. Examples of this fiber include natural fibers, regenerated fibers, semi-synthetic fibers, and synthetic fibers. These fibers may be one type, or may be a combination of two types or more. However, from the viewpoint of strength and formability, this fiber is preferably a synthetic fiber, more preferably a polyester fiber, and even more preferably a polyethylene terephthalate. The fibrous base material 20 may be colored with a known dye or pigment. The dye or pigment is not particularly limited.

A thickness of the fibrous base material 20 is not particularly limited. However, the thickness of the fibrous base material 20 is preferably from 0.2 to 10 mm, and more preferably from 0.5 to 2 mm. By setting the thickness of the fibrous base material 20 to 0.2 mm or more, the formability and the tactile feeling of the synthetic leather 10 can be improved. By setting the thickness of the fibrous base material 20 to 10 mm or less, the abrasion resistance of the synthetic leather 10 can be improved.

The porous resin layer 30 has a plurality of holes 40 (see FIG. 1). The porous resin layer 30 contains a plurality of hollow particles 43 in a resin serving as a base material of the porous resin layer 30. The hollow particle 43 is a fine particle and has a hole 40 inside. The plurality of hollow particles 43 is dispersed in the resin that serves as the base material of the porous resin layer 30. The porous resin layer 30 is preferably a laminated body of two layers or more. In the embodiment, the porous resin layer 30 is a two-layer laminated body including the first porous resin layer 31 and the second porous resin layer 32. When the porous resin layer 30 is a laminated body of three or more layers, the second porous resin layer 32 is provided on the front side of the first porous resin layer 31 in the thickness direction.

The porous resin layer 30 is softer than a non-porous resin layer made of the same material and having the same thickness. The non-porous resin layer to be compared differs from the point that the porous resin layer 30 does not have holes 40, but is the same as the porous resin layer 30 in other aspects. The plurality of holes 40 soften the porous resin layer 30. The softness of the porous resin layer 30 improves the texture of the synthetic leather 10. The synthetic leather 10, by appropriately setting the thickness of the porous resin layer 30, suppresses a decrease in the abrasion resistance of the synthetic leather 10 due to the softness of the porous resin layer 30. The thickness of the porous resin layer 30 is determined according to the thickness of the first porous resin layer 31 and the thickness of the second porous resin layer 32. The thickness of the first porous resin layer 31 and the thickness of the second porous resin layer 32 will be described later.

The first porous resin layer 31 has a plurality of first holes 41 (see FIG. 1). The plurality of first holes 41 is a part of the plurality of holes 40. The second porous resin layer 32 has a plurality of second holes 42 (see FIG. 1). The plurality of second holes 42 is a part of the plurality of holes 40. However, the second hole 42 is the hole 40 different from the first hole 41. In the embodiment, when the first hole 41 and the second hole 42 are not distinguished or are collectively referred to, they are referred to as "hole 40".

The first hole 41 may be a closed space, or may be an open space. However, from the viewpoint of the abrasion resistance of the synthetic leather 10, the first hole 41 is preferably a closed space. By making the first hole 41 as a closed space, generation of cracks starting from the first hole 41 can be suppressed. In the embodiment, it is assumed that the first hole 41 is a closed space (see FIG. 1). The shape of the first hole 41 is not particularly limited. The shape of the first hole 41 may be a regular shape, or may be an irregular shape. An example of the shape of the first hole 41 includes a spherical shape. The spherical shape may be a true-sphere shape, or may be a long-sphere shape.

When manufacturing the first porous resin layer 31, the plurality of first holes 41 is formed in the resin serving as the base material by known foam molding. The plurality of first holes 41 is dispersed in the resin that serves as the base material of the first porous resin layer 31. Examples of methods for forming the plurality of first holes 41 include physical foaming, chemical foaming, and wet coagulation. Physical foaming may utilize mechanical stirring. As for chemical foaming, a foaming agent may be added, or a chemical reaction may be used.

The second hole 42 is a closed space (see FIG. 1). By making the second hole 42 as a closed space, generation of cracks starting from the second hole 42 can be suppressed. Furthermore, the second hole 42 is a closed space inside the hollow particle 43. In this case, the porous resin layer 30 contains the plurality of hollow particles 43 in the resin that serves as the base material of the second porous resin layer 32. The hollow particle 43 in the second porous resin layer 32 has the second hole 42 inside. In the porous resin layer 30, the hollow particles 43 are dispersed in the resin that serves as the base material of the second porous resin layer 32. The shape of the second hole 42 is not particularly limited. The shape of the second hole 42 may be a regular shape, or may be an irregular shape. An example of the shape of the second hole 42 includes a spherical shape. The spherical shape may be a true-sphere shape, or may be a long-sphere shape. However, from the viewpoint of durability of the synthetic leather 10, the shape of the second hole 42 is preferably a true-sphere shape.

The hollow particle 43 has a spherical shape. The hollow particle 43, as described above, has a micro-space inside that become the second hole 42. A coating film covering this space with hollow particle 43 is called an outer shell or an outer wall. In the embodiment, this coating film is referred to as an "outer shell". It is preferable that the hollow particle 43 has a characteristic that volume expansion does not occur or volume expansion does not easily occur due to heat treatment. By containing the hollow particles 43 having such characteristic in the second porous resin layer 32, volume variation of the second porous resin layer 32 can be suppressed during the production of the synthetic leather 10, furthermore, it is possible to suppress variations in the shape, size, and distribution of the plurality of second holes 42.

In the second porous resin layer 32, the hollow particle 43 is appropriately determined in consideration of the characteristic described above. An example of the hollow particle 43 includes organic hollow particle having outer shell made of the following materials. Examples of the previously mentioned materials include thermosetting resins and thermoplastic resins. Examples of the thermosetting resins forming the outer shell include phenolic resins, epoxy resins, and urea resins. Examples of the thermoplastic resins forming the outer shell include acrylic resins and vinyl chloride resins. An example of the hollow particle 43 includes inorganic hollow particle having outer shell made of the following materials. Examples of the previously mentioned materials include glass, shirasu, silica, alumina, and carbon. In addition, in the hollow particle 43, the surface of the organic hollow particle may be coated with inorganic fine powders. Examples of materials for the inorganic fine powders include calcium carbonate, talc, and titanium oxide.

The hollow particle 43 is preferably organic hollow particle of the first aspect or the second aspect from the following viewpoint. The previously mentioned viewpoint is that the hollow particles 43 can be easily deformed by heating and pressing the synthetic leather 10 during embossing of the synthetic leather 10. Furthermore, the previously mentioned viewpoint is that the hollow particles 43 can maintain their shape after deformation. The organic hollow particle of the first aspect has an outer shell made of thermoplastic resin. The organic hollow particle of the second aspect has the outer shell made of thermoplastic resin whose surface is coated with inorganic fine powders.

When the hollow particle 43 has the outer shell made of thermoplastic resin, the softening temperature of the thermoplastic resin is preferably from 110 to 210° C., and more preferably from 130 to 190° C. By setting the softening temperature of the thermoplastic resin forming the outer shell of the hollow particle 43 within the previous mentioned range, the outer shell of the hollow particles 43 can be easily deformed by heating and pressing the synthetic leather 10 during embossing of the synthetic leather 10. The hollow particles 43 maintain their shape after deformation.

The softening temperature of the thermoplastic resin forming the outer shell of the hollow particle 43 can be measured by the following method. That is, the measuring device may be a thermomechanical analyzer (TMA2940) manufactured by TA instruments. The hollow particles 43 of 250 μg are placed in an aluminum cup with a diameter of 7 mm and a depth of 1 mm. Thereafter, the hollow particles 43 in the cup are heated from 80 to 300° C. at a temperature increase rate of 5° C./min while a force of 0.1 N is applied from above. While the hollow particles 43 is being heated, the displacement of the applying indenter in a vertical direction is continuously measured. The temperature at which the maximum amount of displacement occurs is defined as the softening temperature.

When the hollow particle 43 has an outer shell made of thermoplastic resin, the hollow particle 43 may be formed using a microcapsule type foaming agent as a material. The microcapsule type foaming agent encapsulates a volatile foaming agent in the following outer shell. The previously mentioned outer shell is made of thermoplastic resin that can be softened and expanded by heat treatment. An example of volatile foaming agent includes low boiling hydrocarbons. In a step of forming the second porous resin layer 32, the microcapsule type foaming agent may be foamed in the composition liquid prepared in this step. However, it is preferable that the hollow particles 43 are formed in advance using the microcapsule type foaming agent as a material. A plurality of pre-formed hollow particles 43 is included in a composition liquid B to form the plurality of second holes 42. The composition liquid B is used in step B. Step B forms the second porous resin layer 32. The step B and the composition liquid B will be described later.

Inclusion of the microcapsule type foaming agent is preferably lower hydrocarbon with a boiling point of 0 to 100° C. from the viewpoint of shape retention of the microcapsule in a low temperature environment. Examples of such inclusions include butane, isobutane, pentane, isopentane and neopentane. When forming the hollow particle 43 from the microcapsule type foaming agent, the microcapsule type foaming agent is heat treated. This heat treatment softens the outer shell of the microcapsule type foaming agent and changes the inclusion into gas. Accordingly, the microcapsule type foaming agent is formed into the hollow particle 43 containing a closed space inside. This closed space forms the second hole 42.

The plurality of hollow particles 43 in the second porous resin layer 32 may be one type, or may be a combination of two types or more. Assume that the plurality of hollow particles 43 in the second porous resin layer 32 are a combination of two types or more. In this case, it is preferable that two types or more of hollow particles 43 have spaces of the same shape inside. The plurality of second holes 42 can have the same shape.

The first hole 41 has a long diameter of a first dimension. Assume that the first hole 41 is a closed space having a true-sphere shape. In this case, the long diameter of the first hole 41 matches the diameter of the first hole 41 which is a true-sphere shape. Assume that the first hole 41 is a closed space having a shape different from a true-sphere shape. In this case, the long diameter of the first hole 41 matches the maximum dimension of the first hole 41. The second hole 42 has a long diameter of a second dimension. Assume that the second hole 42 is a closed space having a true-sphere shape. In this case, the long diameter of the second hole 42 matches the diameter of the second hole 42 which is a true-sphere shape. Assume that the second hole 42 is a closed space having a shape different from a true-sphere shape. In this case, the long diameter of the second hole 42 matches the maximum dimension of the second hole 42.

Assume that the synthetic leather 10 is before embossing (see FIG. 1). In this case, the first dimension of the long diameter of the first hole 41 and the second dimension of the long diameter of the second hole 42 are preferably the following values. That is, the first dimension of the long diameter of the first hole 41 is preferably 320 μm or less, and more preferably from 100 to 280 μm. The second dimension of the long diameter of the second hole 42 is preferably 200 μm or less, and more preferably from 50 to 80 μm. In the synthetic leather 10 before embossing, the relationship between the first dimension and the second dimension is preferably set to be "first dimension>second dimension".

Assume that the synthetic leather 10 is after embossing (see FIG. 2). In this case, the first dimension of the long diameter of the first hole 41 and the second dimension of the long diameter of the second hole 42 are preferably the following values. That is, the first dimension of the long diameter of the first hole 41 is smaller than before embossing in an area of a concave portion 72 of the concavo-convex pattern 71, preferably 260 μm or less, and more preferably 180 μm or less. The first hole 41 may disappear in the area of the concave portion 72 of the concavo-convex pattern 71. The first dimension of the long diameter of the first hole 41 is preferably 320 μm or less in an area of a convex portion 73 of the concavo-convex pattern 71, as similarly before embossing, and more preferably from 100 to 280 μm. The second dimension of the long diameter of the second hole 42 is smaller than before embossing in the area of the concave portion 72 of the concavo-convex pattern 71, preferably 150 μm or less, and more preferably 40 μm or less. The second hole 42 may disappear in the area of the concave portion 72 of the concavo-convex pattern 71. The second dimension of the long diameter of the second hole 42 is preferably 200 μm or less in the area of the convex portion 73 of the concavo-convex pattern 71, as similarly before embossing, and more preferably from 50 to 80 μm.

The first porous resin layer 31 uses a polyurethane resin as a base material. Polyurethane resin is a general term for the following polyurethane and resin whose main component is this polyurethane. The previously mentioned polyurethane is a polymer compound having urethane bond in its main chain. The polyurethane resin serving as the base material of the first porous resin layer 31 may be a copolymer containing urethane bond, or may be a mixture of polyurethane and other resin. An example of the copolymer containing urethane bond includes acrylic urethane resin. The polyurethane resin that serves as the base material of the first porous resin layer 31 is not particularly limited. Examples of this polyurethane resin include a polycarbonate-based polyurethane resin, a polyether-based polyurethane resin, and a polyester-based polyurethane resin. This polyurethane resin is preferably a polycarbonate-based polyurethane resin from the viewpoint of durability of the synthetic leather 10. The polycarbonate-based polyurethane resin is harder than the polyether-based polyurethane resin and the polyester-based polyurethane resin, and has excellent heat resistance.

The polyurethane resin that serves as the base material of the first porous resin layer 31 may be a solvent-free type (solventless), a solvent-based type, or a water-based type, and is not particularly limited in this respect. Furthermore, this polyurethane resin may be an one-component type or a two-component type. However, from the viewpoint of environmental impact, it is preferable that this polyurethane resin is the solvent-free type (solventless), and from the viewpoint of case of forming a porous layer by chemical foaming, the two-component type is preferable.

The first porous resin layer 31 is formed from a composition liquid A. The composition liquid A is used in step A. Step A forms the first porous resin layer 31. The composition liquid A may contain an additive. The additive is included within a range that does not impair the physical properties that should be imparted to the first porous resin layer 31. Examples of additives include crosslinking agents, catalysts, leveling agents, pigments and matting agents. The additives may be one type, or may be two types or more. Furthermore, the composition liquid A may contain the following solvent. An example of the previously mentioned solvent includes organic solvent. This solvent is preferably methyl ethyl ketone or dimethyl sulfoxide. The step A and the composition liquid A will be described later.

The second porous resin layer 32, similar with the first porous resin layer 31, uses a polyurethane resin as a base material. The polyurethane resin serving as the base material of the second porous resin layer 32 is preferably a polycarbonate-based polyurethane resin, a polyether-based polyurethane resin, or a polyester-based polyurethane resin. This polyurethane resin is preferably a polycarbonate-based polyurethane resin from the viewpoint of durability of the synthetic leather 10, and is preferably a polyether-based polyurethane resin from the viewpoint of texture.

The polyurethane resin that serves as the base material of the second porous resin layer 32 may be a solvent-free type (solventless), a solvent-based type, or a water-based type, and is not particularly limited in this respect. Furthermore, this polyurethane resin may be an one-component type or a two-component type. However, this polyurethane resin is preferably a solvent-free type (solventless) or a water-based type from the viewpoint of environmental impact, and is preferably an one-component type from the viewpoint of versatility and uniform formation of the second porous resin layer 32.

The composition liquid B may contain an additive. The additive is included within a range that does not impair the physical properties that should be imparted to the second porous resin layer 32. Examples of additives include crosslinking agents, catalysts, leveling agents, pigments, matting agents, smoothing agents, surfactants, fillers and thickeners. The additives may be one type, or may be two types or more. Furthermore, the composition liquid B may contain the following solvent. An example of the previously mentioned solvent includes highly polar solvent. This solvent is preferably water from the viewpoint of environmental impact.

The softening temperature of the first porous resin layer 31 is a first temperature. The first temperature is preferably a predetermined value in the range of 170 to 225° C. The softening temperature of the second porous resin layer 32 is a second temperature. The second temperature is preferably a predetermined value in the range of 120 to 170° C. The second temperature is preferably lower than the first temperature. In this case, the temperature difference between the first temperature and the second temperature is preferably from 45 to 75° C.

In the embodiment, "thicknesses T1, T2, and T3" are determined as the thicknesses of the first porous resin layer 31. The thickness T1 of the first porous resin layer 31 is intended for the synthetic leather 10 before embossing (see FIG. 1). The thicknesses T2 and T3 of the first porous resin layer 31 are intended for the synthetic leather 10 after embossing (see FIG. 2). The synthetic leather 10 after embossing can also be called the synthetic leather 10 in the skin material 70. The thickness T2 of the first porous resin layer 31 is intended for the area of the concave portion 72 of the concavo-convex pattern 71. The thickness T3 of the first porous resin layer 31 is intended for the area of the convex portion 73 of the concavo-convex pattern 71.

The thicknesses T1, T2, and T3 of the first porous resin layer 31 are appropriately determined in consideration of various conditions. However, the thickness T1 of the first porous resin layer 31 is preferably from 100 to 320 μm, more preferably from 160 to 280 μm.

The thickness T2 of the first porous resin layer 31 is thinner than the thickness T1 of the first porous resin layer 31, preferably from 100 to 260 μm, and more preferably from 140 to 200 μm. By setting the thickness T2 of the first porous resin layer 31 to 100 μm or more, the texture of the synthetic leather 10 can be improved. By setting the thickness T2 of the first porous resin layer 31 to 260 μm or less, the depth of the concave portion 72 can be improved. To set the thickness T2 of the first porous resin layer 31 to 260 μm or less contributes for making the boundary lines of the concavo-convex pattern 71 in a sharp shape, and further improves the design properties of the skin material 70.

Similar to the thickness T1 of the first porous resin layer 31, the thickness T3 of the first porous resin layer 31 is preferably from 100 to 320 μm, and more preferably from 160 to 280 μm. By setting the thickness T3 of the first porous resin layer 31 to 100 μm or more, the formability and the tactile feeling of the synthetic leather 10 can be improved. By setting the thickness T3 of the first porous resin layer 31 to 320 μm or less, the abrasion resistance of the synthetic leather 10 can be improved.

The thickness T1 of the first porous resin layer 31 can be determined by a known measuring method on the synthetic leather 10 before embossing. In addition, the thickness T1 of the first porous resin layer 31 may be determined by the following method. That is, the thickness T1 of the first porous resin layer 31 may be an average value of the following ten measured values. The previously mentioned ten measured values are obtained by measuring the first porous resin layer 31 at arbitrary ten locations on the synthetic leather 10 which is before embossing. The number of measured values "ten" is an example. This number of measured values is appropriately determined in consideration of various conditions. The thickness T1 of the first porous resin layer 31 does not have to be an average value.

The thickness T2 of the first porous resin layer 31 can be determined by a known measuring method on the synthetic leather 10 after embossing. In addition, the thickness T2 of the first porous resin layer 31 may be determined by the following method. That is, the thickness T2 of the first porous resin layer 31 may be an average value of the following twenty measured values. The previously mentioned twenty measured values are obtained by measuring the first porous resin layer 31 of the synthetic leather 10 which is embossed at arbitrary ten concave portions 72 of the concavo-convex pattern 71. In this case, the number of measurements in one concave portion 72 is two. The number of measured values "twenty", the number of concave portions 72 to be measured "ten", and the number of measured values in one concave portion 72 "two" are examples. These numbers are appropriately determined in consideration of various conditions. The thickness T2 of the first porous resin layer 31 does not have to be an average value.

The thickness T3 of the first porous resin layer 31 can be determined by a known measuring method on the synthetic leather 10 after embossing. In addition, the thickness T3 of the first porous resin layer 31 may be determined by the following method. That is, the thickness T3 of the first porous resin layer 31 may be an average value of the following twenty measured values. The previously mentioned twenty measured values are obtained by measuring the first porous resin layer 31 of the synthetic leather 10 which is embossed at arbitrary ten convex portions 73 of the concavo-convex pattern 71. In this case, the number of measurements in one convex portion 73 is two. The number of measured values "twenty", the number of convex portions 73 to be measured "ten", and the number of measured values in one convex portion 73 "two" are examples. These numbers are appropriately determined in consideration of various conditions. The thickness T3 of the first porous resin layer 31 does not have to be an average value.

The thickness T1 of the first porous resin layer 31 may be measured by enlarging the first porous resin layer 31 in a vertical section of the synthetic leather 10 which is before embossing. The thickness T2 of the first porous resin layer 31 may be measured by enlarging the first porous resin layer 31 at the area of the concave portion 72 in the vertical section of the synthetic leather 10 which is embossed. The thickness T3 of the first porous resin layer 31 may be measured by enlarging the first porous resin layer 31 at the area of the convex portion 73 in the vertical section of the synthetic leather 10 which is embossed. The cutting direction of the synthetic leather 10 matches the thickness direction. A microscope may be used for enlargement. An example of a microscope includes a scanning electron microscope. The magnification ratio is appropriately determined in consideration of various conditions. The thicknesses T1, T2, and T3 of the first porous resin layer 31 may be measured using a scanning electron microscope (S-3000N) manufactured by Hitachi High-Technologies Corporation. In this case, the magnification ratio may be 300 times. The magnification ratio is appropriately determined in consideration of various conditions.

In the synthetic leather 10 after embossing, a compressibility of the first porous resin layer 31 is preferably 20% or less. The compressibility of the first porous resin layer 31 is determined by "$\{(T3-T2)/T3\}\times100$". By setting the compressibility of the first porous resin layer 31 to 20% or less, it is possible to suppress the texture of the synthetic leather 10 from being impaired.

In the embodiment, "thicknesses T4, T5, and T6" are determined as the thicknesses of the second porous resin layer 32. The thickness T4 of the second porous resin layer 32 is intended for the synthetic leather 10 before embossing (see FIG. 1). The thicknesses T5 and T6 of the second porous resin layer 32 are intended for the synthetic leather 10 after embossing (see FIG. 2). As described above, the synthetic leather 10 after embossing can also be called the synthetic leather 10 in the skin material 70. The thickness T5 of the second porous resin layer 32 is intended for the area of the concave portion 72 of the concavo-convex pattern 71. The thickness T6 of the second porous resin layer 32 is intended for the area of the convex portion 73 of the concavo-convex pattern 71.

The thicknesses T4, T5, and T6 of the second porous resin layer 32 are appropriately determined in consideration of various conditions. However, the thickness T4 of the second porous resin layer 32 is preferably from 20 to 300 μm, and more preferably from 65 to 85 μm. The thickness T4 of the second porous resin layer 32 can be measured according to the method for measuring the thickness T1 of the first porous resin layer 31 as described above.

The thickness T5 of the second porous resin layer 32 is thinner than the thickness T4 of the second porous resin layer 32, preferably from 10 to 150 μm, and more preferably from 40 to 70 μm. By setting the thickness T5 of the second porous resin layer 32 to 10 μm or more, the texture of the synthetic leather 10 can be improved. By setting the thickness T5 of the second porous resin layer 32 to 150 μm or less, the depth of the concave portion 72 can be improved. To set the thickness T5 of the second porous resin layer 32 to 150 μm or less contributes for making the boundary lines of the concavo-convex pattern 71 in a sharp shape, and further improves the design properties of the skin material 70. The thickness T5 of the second porous resin layer 32 can be measured according to the method for measuring the thickness T2 of the first porous resin layer 31 as described above.

Figure 6:
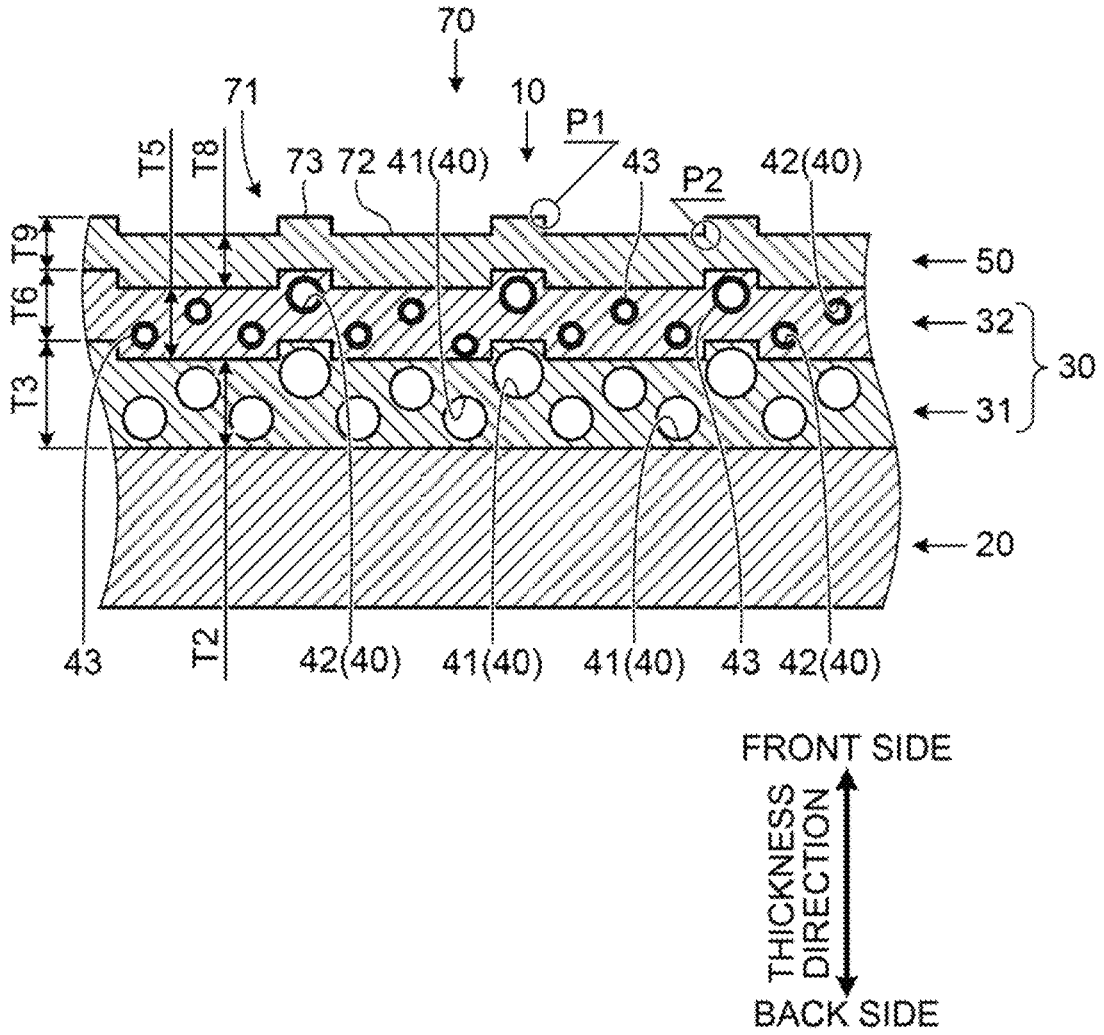
FIG. 6 is a cross-sectional view showing another example of a schematic structure of the skin material.

Similarly to the thickness T4 of the second porous resin layer 32, the thickness T6 of the second porous resin layer 32 is preferably from 20 to 300 μm, and more preferably from 65 to 85 μm. By setting the thickness T6 of the second porous resin layer 32 to 20 μm or more, the depth of the concave portion 72 can be improved. To set the thickness T6 of the second porous resin layer 32 to 20 μm or more contributes for making the boundary lines of the concavo-convex pattern 71 in a sharp shape, and further improves the design properties of the skin material 70. By setting the thickness T6 of the second porous resin layer 32 to 300 μm or less, the abrasion resistance of the synthetic leather 10 can be improved. The thickness T6 of the second porous resin layer 32 can be measured according to the method for measuring the thickness T3 of the first porous resin layer 31 as described above. In FIG. 2, and in FIG. 6 which is described later, the thickness T5 and T6 of the second porous resin layer 32 is drawn with the same thickness.

In the synthetic leather 10 after embossing, a compressibility of the second porous resin layer 32 is preferably from 40 to 55%. The compressibility of the second porous resin layer 32 is determined by "{(T6−T5)/T6}×100". By setting the compressibility of the second porous resin layer 32 to 40% or more, the formability of the synthetic leather 10 can be improved. By setting the compressibility of the second porous resin layer 32 to 55% or less, the thickness of the synthetic leather 10 can be maintained with the skin material 70, and the texture of the synthetic leather 10 can be improved.

The non-porous resin layer 50 conceals the porous resin layer 30 on the front side in the thickness direction. Furthermore, the non-porous resin layer 50 colors the front face of the synthetic leather 10 in a desired color. The non-porous resin layer 50 may be made of the same resin as the base material of the first porous resin layer 31 as a base material. The resin serving as the base material of the non-porous resin layer 50 is preferably a polycarbonate-based polyurethane resin from the viewpoint of the abrasion resistance and texture of the synthetic leather 10. The resin serving as the base material of the non-porous resin layer 50 may be a solvent-free type (solventless), a solvent-based type, or a water-based type, and is not particularly limited in this respect.

The non-porous resin layer 50 contains a coloring agent in a resin serving as the base material. This coloring agent is not particularly limited. An example of the coloring agent includes pigments. Examples of the pigments include inorganic pigments and organic pigments. The non-porous resin layer 50 may contain a known pigment as the coloring agent. The pigment is included in a composition liquid C. The composition liquid C is used in step C. Step C forms the non-porous resin layer 50. The step C and the composition liquid C will be described later.

The content of the coloring agent is not particularly limited, and is appropriately determined in consideration of various conditions. For example, the content of the coloring agent may be determined as appropriate depending on the color desired for the synthetic leather 10. However, the content of the coloring agent is preferably from 5 to 25 mass %, and more preferably from 10 to 20 mass %, in terms of solid content, based on the entire composition liquid C.

By setting the content of the coloring agent to 5 mass % or more, the concealing properties of the porous resin layer 30 and the coloring properties of the surface of the synthetic leather 10 can be improved. A viewer of the skin material 70 can recognize the color of the front face of the synthetic leather 10 as a design provided on the front face of the skin material 70. By setting the content of the coloring agent to 25 mass % or less, it is possible to suppress a decrease in the strength of the non-porous resin layer 50. By suppressing the decrease in the strength of the non-porous resin layer 50, the abrasion resistance of the synthetic leather 10 can be improved.

The composition liquid C may contain an additive. The additive is included within a range that does not impair the physical properties that should be imparted to the non-porous resin layer 50. Examples of the additives include smoothing agents, crosslinking agents, matting agents and leveling agents. The additives may be one type, or may be two types or more. Furthermore, the composition liquid C may contain the following solvent. An example of the previously mentioned solvents includes highly polar solvent. This solvent is preferably water from the viewpoint of environmental impact.

The softening temperature of the non-porous resin layer 50 is a third temperature. The third temperature is preferably higher than the first temperature, which is the softening temperature of the first porous resin layer 31. That is, the relationship between the first temperature, the second temperature (the softening temperature of the second porous resin layer 32), and the third temperature is preferably "third temperature>first temperature>second temperature". By setting the softening temperature of the non-porous resin layer 50 higher than that of the first porous resin layer 31 (third temperature>first temperature), the skin material 70 can suppress shine on the surface of the synthetic leather 10. The design of the skin material 70 can be improved. The third temperature is preferably a predetermined value in the range of 190 to 240° C.

In the embodiment, "thicknesses T7, T8, and T9" are determined as the thicknesses of the non-porous resin layer 50. The thickness T7 of the non-porous resin layer 50 is intended for the synthetic leather 10 before embossing (see FIG. 1). The thicknesses T8 and T9 of the non-porous resin layer 50 are intended for the synthetic leather 10 after embossing (see FIG. 2). As described above, the synthetic leather 10 after embossing can also be called the synthetic leather 10 in the skin material 70. The thickness T8 of the non-porous resin layer 50 is intended for the area of the concave portion 72 of the concavo-convex pattern 71. The thickness T9 of the non-porous resin layer 50 is intended for the area of the convex portion 73 of the concavo-convex pattern 71.

The thicknesses T7, T8, and T9 of the non-porous resin layer 50 are appropriately determined in consideration of various conditions. However, the thickness T7 of the non-porous resin layer 50 is preferably from 20 to 80 μm, and more preferably from 25 to 50 μm. The thickness T7 of the non-porous resin layer 50 can be measured according to the method for measuring the thickness T1 of the first porous resin layer 31 as described above.

The thickness T8 of the non-porous resin layer 50 is thinner than the thickness T7 of the non-porous resin layer 50, preferably from 15 to 60 μm, and more preferably from 15 to 40 μm. By setting the thickness T8 of the non-porous resin layer 50 to 15 μm or more, the texture of the synthetic leather 10 can be improved. By setting the thickness T8 of the non-porous resin layer 50 to 60 μm or less, the depth of the concave portion 72 can be improved. To set the thickness T8 of the non-porous resin layer 50 to 60 μm or less contributes for making the boundary lines of the concavo-convex pattern 71 in a sharp shape, and further improves the design properties of the skin material 70. The thickness T8 of the non-porous resin layer 50 can be measured according to the method for measuring the thickness T2 of the first porous resin layer 31 as described above.

Similarly to the thickness T7 of the non-porous resin layer 50, the thickness T9 of the non-porous resin layer 50 is preferably from 20 to 80 μm, and more preferably from 25 to 50 μm. By setting the thickness T9 of the non-porous resin layer 50 to 20 μm or more, the concealing properties of the porous resin layer 30 and the coloring properties of the surface of the synthetic leather 10 can be improved. The viewer of the skin material 70 can recognize the color of the front face of the synthetic leather 10 as a design provided on the front face of the skin material 70. By setting the thickness T9 of the non-porous resin layer 50 to 80 μm or less, the formability of the synthetic leather 10 can be improved. The thickness T9 of the non-porous resin layer 50 can be measured according to the method for measuring the thickness T3 of the first porous resin layer 31 described above. In FIG. 2, and in FIG. 6 which is described later, the thickness T8 and T9 of the non-porous resin layer 50 is drawn with the same thickness.

In the synthetic leather 10 after embossing, a compressibility of the non-porous resin layer 50 is preferably 40% or less. The compressibility of the non-porous resin layer 50 is determined by "{(T9−T8)/T9}×100". By setting the compressibility of the non-porous resin layer 50 to 40% or less, the durability of the synthetic leather 10 can be improved.

The protective layer 60 protects the synthetic leather 10 on the front side in the thickness direction. The protective layer 60 improves the abrasion resistance of the synthetic leather 10. The protective layer 60 may be made of the same resin as the base material of the first porous resin layer 31 as a base material. From the viewpoint of the abrasion resistance of the synthetic leather 10, the resin serving as the base material of the protective layer 60 is preferably a polycarbonate-based polyurethane resin. The resin serving as the base material of the protective layer 60 may be a solvent-free type (solventless), a solvent-based type, or a water-based type, and is not particularly limited in this respect. A composition liquid D may contain an additive. The composition liquid D is used in step D. The step D forms the protective layer 60. Examples of additives include smoothing agents, crosslinking agents, matting agents and leveling agents. The additives may be one type, or may be two types or more. The step D and the composition liquid D will be described later.

A thickness T10 (see FIGS. 1 and 2) of the protective layer 60 is not particularly limited. However, the thickness T10 of the protective layer 60 is preferably from 1 to 50 μm, and more preferably from 3 to 20 μm. By setting the thickness T10 of the protective layer 60 to 1 μm or more, the abrasion resistance of the synthetic leather 10 can be improved. By setting the thickness T10 of the protective layer 60 to 50 μm or less, the formability of the synthetic leather 10 can be improved. The inventor knows that the thickness T10 of the protective layer 60 does not change or does not change easily before and after embossing.

A total thickness T11 of the non-porous resin layer 50 and the protective layer 60 is not particularly limited. The total thickness T11 is the sum of the thickness T7 of the non-porous resin layer 50 and the thickness T10 of the protective layer 60 (see FIG. 1). However, the total thickness T11 of the non-porous resin layer 50 and the protective layer 60 is preferably from 21 to 130 μm, more preferably from 28 to 70 μm, from the viewpoint of formability of the synthetic leather 10. By setting the total thickness T11 of the non-porous resin layer 50 and the protective layer 60 to 21 μm or more, the abrasion resistance of the synthetic leather 10 can be improved. By setting the total thickness T11 of the non-porous resin layer 50 and the protective layer 60 to 130 μm or less, the formability of the synthetic leather 10 can be improved.

The synthetic leather 10 exerts the functions described above both before embossing and after embossing, except for a specific function before embossing. In this case, the skin material 70 including the synthetic leather 10 exerts the same function as the synthetic leather 10, or the synthetic leather 10 in the skin material 70 exerts the same function as before embossing. In the embodiment, the texture of the synthetic leather 10 can be translated as the texture of the skin material 70, the abrasion resistance of the synthetic leather 10 can be translated as the abrasion resistance of the skin material 70, the durability of the synthetic leather 10 can be translated as the durability of the skin material 70, and the tactile feeling of the synthetic leather 10 can be translated as the tactile feeling of the skin material 70. The time of embossing the synthetic leather 10 has the same meaning as the time of manufacturing the skin material 70 or the time of implementing the manufacturing method of the skin material 70.

<Manufacturing Method of Synthetic Leather 10>

A manufacturing method of the synthetic leather 10 includes four steps A, B, C, and D. When carrying out the manufacturing method of the synthetic leather 10, the fibrous base material 20 is prepared. In step A, as described above, the first porous resin layer 31 is formed. In step A, the composition liquid A is applied and the composition liquid A is solidified. The composition liquid A solidifies to form the first porous resin layer 31. In step B, as described above, the second porous resin layer 32 is formed. In step B, the composition liquid B is applied and the composition liquid B is solidified. The composition liquid B solidifies to form the second porous resin layer 32. In step C, as described above, the non-porous resin layer 50 is formed. In step C, the composition liquid C is applied and the composition liquid C is solidified. The composition liquid C solidifies to form the non-porous resin layer 50. In step D, as described above, the protective layer 60 is formed. In step D, the composition liquid D is applied and the composition liquid D is solidified. The composition liquid D solidifies to form the protective layer 60.

Step A may include a procedure for preparing the composition liquid A. Step B may include a procedure for preparing the composition liquid B. Step C may include a procedure for preparing the composition liquid C. Step D may include a procedure for preparing the composition liquid D. In the embodiment, step A prepares the composition liquid A, step B prepares the composition liquid B, step C prepares the composition liquid C, and step D prepares the composition liquid D. However, the composition liquid A may be prepared in advance before performing step A. In step A, the composition liquid A prepared in advance may be used. The composition liquid B may be prepared in advance before performing step B. In step B, the composition liquid B prepared in advance may be used. The composition liquid C may be prepared in advance before performing step C. In step C, the composition liquid C prepared in advance may be used. The composition liquid D may be prepared in advance before performing step D. In step D, the composition liquid D prepared in advance may be used.

The composition liquids A to D are applied by a known coating method. Examples of coating methods include knife coating, roll coating, gravure coating, and spray coating. The coating method may be different for some or all of steps A to D, or may be the same for all of steps A to D. The coating method adopted in steps A to D is appropriately determined in consideration of various conditions.

The embodiment exemplifies a first manufacturing method, a second manufacturing method, a third manufacturing method, a fourth manufacturing method, and a fifth manufacturing method as manufacturing methods of the synthetic leather 10.

<First Manufacturing Method>

In the first manufacturing method, steps A to D are performed in the order of step A, step B, step C, and step D.

That is, in step A, the composition liquid A is applied onto the fibrous base material 20, and then the composition liquid A is dry-coagulated. The surface of the fibrous base material 20 onto which the composition liquid A is applied is the front face. Step A forms a first intermediate body in which the first porous resin layer 31 is laminated on the front side of the fibrous base material 20 in the thickness direction.

In step B, the composition liquid B is applied onto the first intermediate body, and then the composition liquid B is dry-coagulated. The surface of the first intermediate body onto which the composition liquid B is applied is the front face of the first porous resin layer 31. Step B forms a second intermediate body in which the second porous resin layer 32 is laminated on the front side of the first intermediate body in the thickness direction.

In step C, the composition liquid C is applied onto the second intermediate body, and then the composition liquid C is dry-coagulated. The surface of the second intermediate body onto which the composition liquid C is applied is the front face of the second porous resin layer 32. Step C forms a third intermediate body in which the non-porous resin layer 50 is laminated on the front side of the second intermediate body in the thickness direction.

In step D, the composition liquid D is applied onto the third intermediate body, and then the composition liquid D is dry-coagulated. The surface of the third intermediate body onto which the composition liquid D is applied is the front face of the non-porous resin layer 50. Step D forms a laminated body in which the protective layer 60 is laminated on the front side of the third intermediate body in the thickness direction. This laminated body forms the synthetic leather 10.

<Second Manufacturing Method>

In the second manufacturing method, steps A to D are performed in the order of step C, step B, step A, and step D. That is, in step C, the composition liquid C is applied onto a releasable substrate, and then the composition liquid C is dry-coagulated. When a grained pattern is provided on the front face of the synthetic leather 10, the surface of the releasable substrate onto which the composition liquid C is applied has a shape that is an inversion of the concavo-convex shape of this grained pattern. An example of the releasable substrate includes a release paper. Step C forms a first intermediate body in which the non-porous resin layer 50 is laminated on the releasable substrate.

In step B, the composition liquid B is applied onto the first intermediate body, and then the composition liquid B is dry-coagulated. The surface of the first intermediate body onto which the composition liquid B is applied is the back face of the non-porous resin layer 50. Step B forms a second intermediate body in which the second porous resin layer 32 is laminated on the back side of the first intermediate body in the thickness direction.

In step A, the composition liquid A is applied onto the second intermediate body. The surface of the second intermediate body onto which the composition liquid A is applied is the back face of the second porous resin layer 32. Subsequently, in step A, the first porous resin layer 31 and the fibrous base material 20 are pressure bonded in a state in which the composition liquid A after coating as the first porous resin layer 31 has viscosity. Next, in step A, the releasable substrate is peeled off. Step A forms a third intermediate body in which the non-porous resin layer 50, the second porous resin layer 32, the first porous resin layer 31, and the fibrous base material 20 are laminated from the front side to the back side in the thickness direction.

In step D, the composition liquid D is applied onto the third intermediate body, and then the composition liquid D is dry-coagulated. The surface of the third intermediate body onto which the composition liquid D is applied is the front face of the non-porous resin layer 50. Step D forms a laminated body in which the protective layer 60 is laminated on the front side of the third intermediate body in the thickness direction. This laminated body forms the synthetic leather 10.

<Third Manufacturing Method>

In the third manufacturing method, steps A to D are performed in the order of step C, step B, step A, and step D. That is, in step C, the composition liquid C is applied onto the releasable substrate, and then the composition liquid C is dry-coagulated. When a grained pattern is provided on the front face of the synthetic leather 10, the surface of the releasable substrate onto which the composition liquid C is applied has a shape that is an inversion of the concavo-convex shape of this grained pattern. An example of the releasable substrate includes a release paper. Step C forms a first intermediate body in which the non-porous resin layer 50 is laminated on the releasable substrate.

In step B, the composition liquid B is applied onto the first intermediate body, and then the composition liquid B is dry-coagulated. The surface of the first intermediate body onto which the composition liquid B is applied is the back surface of the non-porous resin layer 50. Step B forms a second intermediate body in which the second porous resin layer 32 is laminated on the back side of the first intermediate body in the thickness direction.

In step A, the composition liquid A is applied onto the second intermediate body, and then the composition liquid A is dry-coagulated. The surface of the second intermediate body onto which the composition liquid A is applied is the back face of the second porous resin layer 32. Subsequently, in step A, an adhesive is applied onto the first porous resin layer 31 to bond the first porous resin layer 31 and the fibrous base material 20. The adhesive is applied onto the back face of the first porous resin layer 31. Next, in step A, the releasable substrate is peeled off. Step A forms a third intermediate body in which the non-porous resin layer 50, the second porous resin layer 32, the first porous resin layer 31, and the fibrous base material 20 are laminated from the front side to the back side in the thickness direction.

In step D, the composition liquid D is applied onto the third intermediate body, and then the composition liquid D is dry-coagulated. The surface of the third intermediate body onto which the composition liquid D is applied is the front face of the non-porous resin layer 50. Step D forms a laminated body in which the protective layer 60 is laminated on the front side of the third intermediate body in the thickness direction. This laminated body forms the synthetic leather 10. This synthetic leather 10 includes an adhesive layer between the fibrous base material 20 and the first porous resin layer 31.

<Fourth Manufacturing Method>

In the fourth manufacturing method, steps A to D are performed in the order of step D, step C, step B, and step A. That is, in step D, the composition liquid D is applied onto the releasable substrate, and then the composition liquid D is dry-coagulated. The shape of the surface of the releasable substrate onto which composition liquid D is applied is appropriately determined in consideration of various conditions. An example of the releasable substrate includes a release paper. When the releasable substrate is the release paper, the shape of the surface of the release paper onto which the composition liquid D is applied may be either a smooth shape or a concavo-convex shape. Step D forms a first intermediate body in which the protective layer 60 is laminated on the releasable substrate.

In step C, the composition liquid C is applied onto the first intermediate body, and then the composition liquid C is dry-coagulated. The surface of the first intermediate body onto which the composition liquid C is applied is the back face of the protective layer 60. Step C forms a second intermediate body in which the non-porous resin layer 50 is laminated on the back side of the first intermediate body in the thickness direction.

In step B, the composition liquid B is applied onto the second intermediate body. The surface of the second intermediate body onto which the composition liquid B is applied is the back face of the non-porous resin layer 50. Step B forms a third intermediate body in which the second porous resin layer 32 is laminated on the back side of the second intermediate body in the thickness direction.

In step A, the composition liquid A is applied onto the third intermediate body. The surface of the third intermediate body onto which the composition liquid A is applied is the back face of the second porous resin layer 32. Subsequently, in step A, the first porous resin layer 31 and the fibrous base material 20 are pressure bonded in a state in which the composition liquid A after coating as the first porous resin layer 31 has viscosity. Next, in step A, the releasable substrate is peeled off. Step A forms a laminated body in which the protective layer 60, the non-porous resin layer 50, the second porous resin layer 32, the first porous resin layer 31, and the fibrous base material 20 are laminated from the front side to the back side in the thickness direction. This laminated body forms the synthetic leather 10.

<Fifth Manufacturing Method>

In the fifth manufacturing method, steps A to D are performed in the order of step D, step C, step B, and step A. That is, in step D, the composition liquid D is applied onto the releasable substrate, and then the composition liquid D is dry-coagulated. The shape of the surface of the releasable substrate onto which the composition liquid D is applied is appropriately determined in consideration of various conditions. An example of the releasable substrate includes a release paper. When the releasable substrate is the release paper, the shape of the surface of the release paper onto which the composition liquid D is applied may be either a smooth shape or a concavo-convex shape. Step D forms a first intermediate body in which the protective layer 60 is laminated on the releasable substrate.

In step C, the composition liquid C is applied onto the first intermediate body, and then the composition liquid C is dry-coagulated. The surface of the first intermediate body onto which the composition liquid C is applied is the back face of the protective layer 60. Step C forms a second intermediate body in which the non-porous resin layer 50 is laminated on the back side of the first intermediate body in the thickness direction.

In step B, the composition liquid B is applied onto the second intermediate body. The surface of the second intermediate body onto which the composition liquid B is applied is the back face of the non-porous resin layer 50. Step B forms a third intermediate body in which the second porous resin layer 32 is laminated on the back side of the second intermediate body in the thickness direction.

In step A, the composition liquid A is applied onto the third intermediate body, and then the composition liquid A is dry-coagulated. The surface of the third intermediate body onto which the composition liquid A is applied is the back face of the second porous resin layer 32. Subsequently, in step A, an adhesive is applied onto the first porous resin layer 31 to bond the first porous resin layer 31 and the fibrous base material 20. The adhesive is applied onto the back face of the first porous resin layer 31. Next, in step A, the releasable substrate is peeled off. Step A forms a laminated body in which the protective layer 60, the non-porous resin layer 50, the second porous resin layer 32, the first porous resin layer 31, and the fibrous base material 20 are laminated from the front side to the back side in the thickness direction. This laminated body forms the synthetic leather 10. This synthetic leather 10 includes an adhesive layer between the fibrous base material 20 and the first porous resin layer 31.

<Manufacturing Method of Skin Material 70 and Embossing Apparatus 80>

A manufacturing method of the skin material 70 and an embossing apparatus 80 will be explained with reference to FIGS. 1 to 3. In this explanation, it is assumed that the synthetic leather 10 is a long sheet material. In this case, the skin material 70 also becomes a long sheet material. However, the synthetic leather 10 and the skin material 70 may be short sheet materials. The above-described thickness direction (front side and back side) is used as the direction for specifying the embossing apparatus 80. The manufacturing method of the skin material 70 includes an embossing process. The embossing process is carried out by the embossing apparatus 80. The embossing apparatus 80 embosses the unprocessed synthetic leather 10 (see FIG. 1) in the embossing process.

Figure 3:
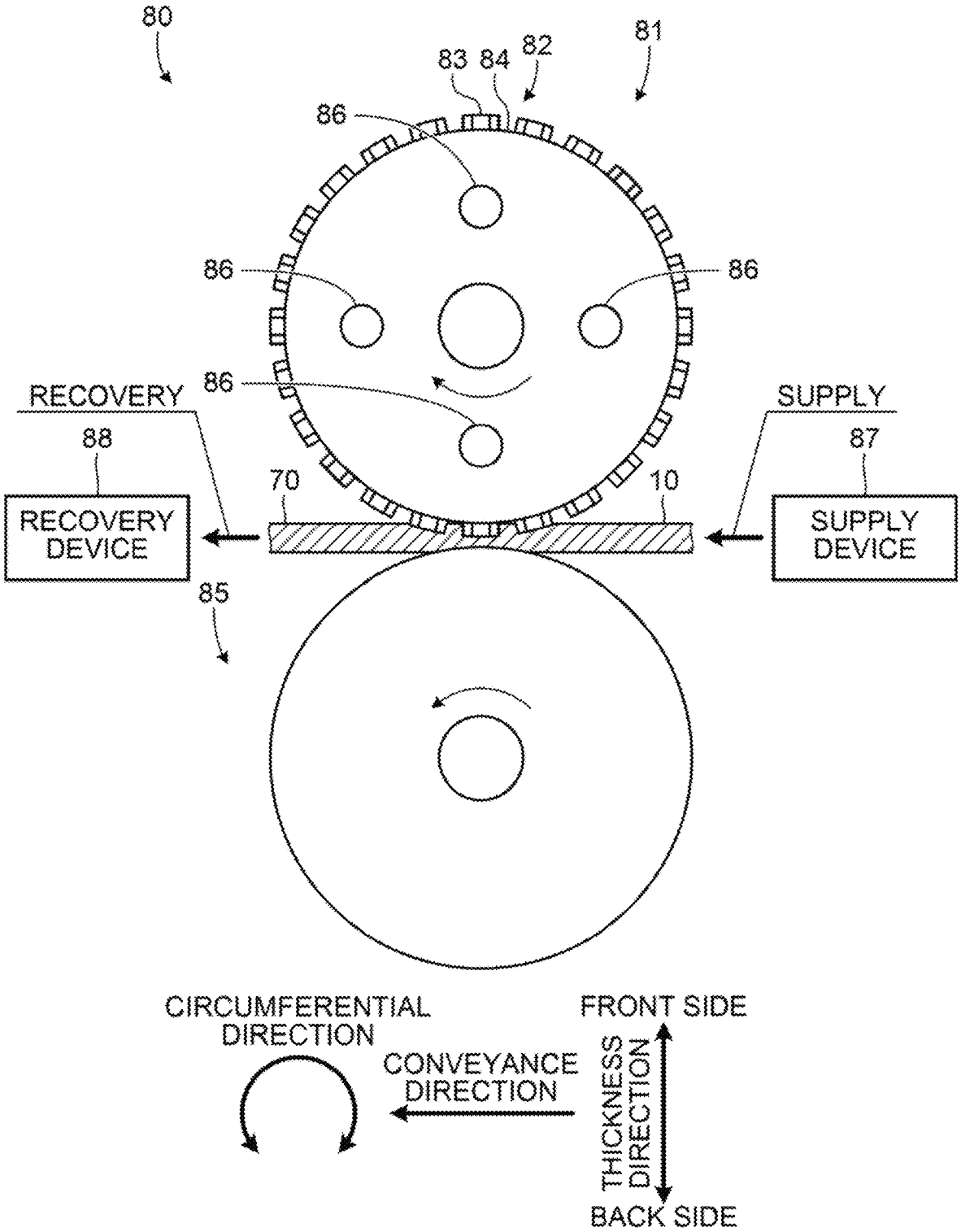
FIG. 3 is a side view showing an example of a schematic structure of an embossing apparatus. The embossing apparatus which is carrying out an embossing process of a manufacturing method of the skin material is shown. An embossing die and an embossing receiving die have a roll shape. In the synthetic leather and the skin material, portions corresponding to the embossing apparatus are shown.

The embossing apparatus 80 includes an embossing die 81, an embossing receiving die 85, and a heater 86 (see FIG. 3). The embossing die 81 has a roll shape. The embossing receiving die 85 has a roll shape. The embossing die 81 and the embossing receiving die 85 are provided side by side in the thickness direction. The embossing die 81 is provided on the front side of the synthetic leather 10 in the thickness direction. The embossing receiving die 85 is provided on the back side of the synthetic leather 10 in the thickness direction.

The embossing apparatus 80 includes a supply device 87 and a recovery device 88 (see FIG. 3). In FIG. 3, the illustration of the supply device 87 and the recovery device 88 is simplified. The supply device 87 and the recovery device 88 are intended for the synthetic leather 10 and the skin material 70 in the aspect of a long sheet material. The supply device 87 supplies the unprocessed synthetic leather 10 to the embossing die 81 and the embossing receiving die 85. The recovery device 88 recovers the skin material 70. The embossing apparatus 80 can adopt a supply device and a recovery device that are similar to a known embossing apparatus as the supply device 87 and the recovery device 88. Therefore, other explanations regarding the supply device 87 and the recovery device 88 will be omitted.

The synthetic leather 10 and the skin material 70 continues from the supply device 87 to the recovery device 88, and are conveyed from the supply device 87 toward the recovery device 88. During conveyance from the supply device 87 to the recovery device 88, the synthetic leather 10 passes between the embossing die 81 and the embossing receiving die 85, and is formed into the skin material 70 (embossing process). In the embodiment, a direction in which the synthetic leather 10 and the skin material 70 are conveyed is referred to as a "conveyance direction". Both the embossing die 81 and the embossing receiving die 85 have a roll shape. In this case, the embossing die 81 and the embossing receiving die 85 rotate in a direction corresponding to the conveyance direction. However, a direction of rotation of the embossing receiving die 85 is opposite to a direction of rotation of the embossing die 81. In FIG. 3, an arc arrow inside the embossing die 81 indicates the rotation direction of the embossing die 81, and an arc arrow inside the embossing receiving die 85 indicates the rotation direction of the embossing receiving die 85.

The embossing die 81 includes molding portions 82. The molding portion 82 has a concavo-convex shape that is an inversion of the concavo-convex shape of the concavo-convex pattern 71. The molding portions 82 contact the front face of the synthetic leather 10 and press the front face of the synthetic leather 10 when the synthetic leather 10 passes between the embossing die 81 and the embossing receiving die 85. The molding portion 82 includes a convex portion 83 and a concave portion 84. The convex portion 83 has a shape corresponding to the concave portion 72 of the concavo-convex pattern 71 and bites into the front face of the synthetic leather 10. The concave portion 84 has a shape corresponding to the convex portion 73 of the concavo-convex pattern 71. The following portion of the synthetic leather 10 enters into the concave portion 84. The previously mentioned portion forms the convex portion 73 of the concavo-convex pattern 71.

When the synthetic leather 10 passes between the embossing die 81 and the embossing receiving die 85, the embossing receiving die 85 contacts the back face of the synthetic leather 10 and supports the synthetic leather 10 from the back side in the thickness direction. The following surface of the embossing receiving die 85 may be formed of an elastic material. The previously mentioned surface contacts the back face of the synthetic leather 10 when the synthetic leather 10 passes between the embossing die 81 and the embossing receiving die 85. In the embodiment, the surface of the embossing receiving die 85 that is in contact with the back surface of the synthetic leather 10 is referred to as an "outer surface of the embossing receiving die 85". The outer surface of the embossing receiving die 85 may be a smooth surface. "Smooth" means a state without elevation difference or unevenness.

Examples of elastic materials that form the outer surface of the embossing receiving die 85 include rubber, thermoplastic elastomer, and plastic. Examples of the rubber forming the outer surface of the embossing receiving die 85 include silicone rubber, nitrile rubber, chloroprene rubber, ethylene-propylene rubber, butyl rubber, urethane rubber, fluoro-rubber, and natural rubber. Examples of thermoplastic elastomers forming the outer surface of the embossing receiving die 85 include polyurethane elastomers, nylon elastomers, and polyvinyl chloride elastomers. Examples of plastics forming the outer surface of the embossing receiving die 85 include acrylic resin, polyvinyl chloride resin, polypropylene resin, polystyrene resin, polyethylene resin, and polyethylene terephthalate resin.

The hardness of the elastic material forming the outer surface of the embossing receiving die 85 is preferably from D20 to D95, and more preferably from D50 to D80. Each of the previously mentioned values is an average value of hardness obtained by the following hardness test method. This hardness test method is carried out in accordance with JIS K6253-3:2012 (Vulcanized rubber and thermoplastic rubber-How to determine hardness—Part 3: Durometer hardness).

[Hardness Test Method]

Testing machine: Type D durometer (Kobunshi Keiki Co., Ltd. Digital Rubber Hardness Meter DD4-D type)

Test piece shape (width×length×thickness): 40 mm×60 mm×11 mm

Test environment (temperature, relative humidity): 23±2° C., 50±5% RH

Measurement time: instant

Number of measurement points: 5 points

The heater 86 is provided in the embossing die 81. The heater 86 is embedded inside the embossing die 81. The heater 86 is an electric heater. In the embodiment, four heaters 86 using electric heaters are embedded in the embossing die 81 at equal angular intervals. However, the heater 86 may be of a different type from the electric heater. The number of heaters 86 may be three or less, or five or more. The type and the number of heaters 86 are appropriately determined in consideration of various conditions. The arrangement of the heaters 86 in the embossing die 81 is appropriately determined in consideration of various conditions.

The heater 86 heats the embossing die 81 to a predetermined temperature. In the embodiment, the temperature of the embossing die 81 heated by the heater 86 is referred to as "heating temperature". The embossing apparatus 80 performs the embossing process with the embossing die 81 heated to the heating temperature. The heating temperature is appropriately determined considering various conditions. However, it is preferable to set the heating temperature as follows. The previously mentioned setting is lower than the softening temperature of the first porous resin layer 31 and the softening temperature of the non-porous resin layer 50, and higher than the softening temperature of the second porous resin layer 32.

Assume that the heating temperature is set lower than the softening temperature of the first porous resin layer 31. In this case, the difference between the heating temperature and the softening temperature of the first porous resin layer 31 is preferably 5° C. or more, and more preferably 10° C. or more. The difference between the heating temperature and the softening temperature of the first porous resin layer 31 may be 40° C. or less, or may be 30° C. or less. By setting the heating temperature lower than the softening temperature of the first porous resin layer 31, the thickness of the synthetic leather 10 can be maintained with the skin material 70, and the texture of the synthetic leather 10 can be improved.

Assume that the heating temperature is set higher than the softening temperature of the second porous resin layer 32. In this case, the difference between the heating temperature and the softening temperature of the second porous resin layer 32 is preferably 10° C. or more, and more preferably 20° C. or more. The difference between the heating temperature and the softening temperature of the second porous resin layer 32 may be 50° C. or less, or may be 40° C. or less. By setting the heating temperature higher than the softening temperature of the second porous resin layer 32, the formability of the synthetic leather 10 can be improved. To set the heating temperature higher than the softening temperature of the second porous resin layer 32 contributes for making the boundary lines of the concavo-convex pattern 71 in a sharp shape, and further improves the design properties of the skin material 70.

Assume that the heating temperature is set lower than the softening temperature of the non-porous resin layer 50. In this case, the difference between the heating temperature and the softening temperature of the non-porous resin layer 50 is preferably 20° C. or more, and more preferably 30° C. or more. The difference between the heating temperature and the softening temperature of the non-porous resin layer 50 may be 60° C. or less, or may be 50° C. or less. By setting the heating temperature lower than the softening temperature of the non-porous resin layer 50, the tactile feeling of the synthetic leather 10 can be improved.

A conveyance speed of the synthetic leather 10 in the embossing process is appropriately determined in consideration of various conditions. For example, the conveyance speed of the synthetic leather 10 in the embossing process may be from 0.1 to 20 m/min, or may be from 0.2 to 10 m/min. By setting the conveyance speed of the synthetic leather 10 in the embossing process to 0.1 m/min or more, the formability of the synthetic leather 10 can be improved. It is possible to easily form the concavo-convex pattern 71 on the front face of the synthetic leather 10. By setting the conveyance speed of the synthetic leather 10 in the embossing process to 20 m/min or less, it is possible to prevent the texture of the synthetic leather 10 from becoming rough and hard with the skin material 70.

In addition, in the manufacturing method of the skin material 70, various embossing conditions are appropriately determined in consideration of various conditions. Examples of embossing conditions include pressing force and introduction tension. The pressing force acts on the synthetic leather 10 passing between the embossing die 81 and the embossing receiving die 85. The molding portion 82 bites into the front face of the synthetic leather 10 more strongly as the pressing force increases. The introduction tension acts on the synthetic leather 10 while it is passing through the embossing apparatus 80. By increasing the introduction tension, it is possible to suppress the slack that occurs in the synthetic leather 10 while it is passing through the embossing apparatus 80, and to make this synthetic leather 10 in a stretched state.

The embossing die and the embossing receiving die may have a different aspect from the roll-shaped embossing die 81 and the embossing receiving die 85 shown in FIG. 3. The embossing die and the embossing receiving die may have a flat plate-shape. However, in the embodiment, illustrations of a flat plate-shaped embossing die, a flat plate-shaped embossing receiving die, and an embossing apparatus including these are omitted. When the embossing die and the embossing receiving die have a flat plate-shape, the embossing die reciprocates relative to the embossing receiving die. In this relative reciprocating movement, the movement from the front side to the back side in the thickness direction and the movement from the back side to the front side in the thickness direction are repeated.

In the embossing process, the flat plate-shaped embossing die and embossing receiving die sandwich the synthetic leather 10 in the following state. In the previously mentioned state, the flat plate-shaped embossing die moves to a moving end on the back side in the thickness direction with respect to the flat plate-shaped embossing receiving die. The outer surface of the flat plate-shaped embossing receiving die is a smooth plane. The synthetic leather 10 is pressed by the molding portion of the flat plate-shaped embossing die while being supported on the outer surface of the flat plate-shaped embossing receiving die. This molded portion corresponds to the molded portion 82 and includes a convex portion and a concave portion. The convex portion corresponds to the convex portion 83 and the concave portion corresponds to the concave portion 84. The flat plate-shaped embossing die is heated by a heater. The heater corresponds to the heater 86. The synthetic leather 10 is heated by the flat plate-shaped embossing die. The concavo-convex pattern 71 is formed on the front face of the synthetic leather 10.

A pressing time of the synthetic leather 10 in the embossing process is appropriately determined in consideration of various conditions. The pressing time is the time per one time when the flat plate-shaped embossing die and the embossing receiving die press the synthetic leather 10 in the embossing process. For example, the pressing time of the synthetic leather 10 in the embossing process may be from 15 to 120 second/time, or may be from 20 to 90 second/time. By setting the pressing time of the synthetic leather 10 in the embossing process to 15 second/time or more, the formability of the synthetic leather 10 can be improved. It is possible to easily form the concavo-convex pattern 71 on the front face of the synthetic leather 10. By setting the pressing time of the synthetic leather 10 in the embossing process to 120 second/time or less, it is possible to prevent the texture of the synthetic leather 10 from becoming rough and hard with the skin material 70.

Embossing apparatuses are known. Known embossing apparatus include a roll-shaped embossing die and an embossing receiving die or a flat plate-shaped embossing die and an embossing receiving die. In the manufacturing method of the skin material 70, an apparatus equivalent to a known embossing apparatus can be adopted as the embossing apparatus 80. The manufacturing method of the skin material 70 can be carried out in the same manner as an embossing method carried out using a known embossing apparatus. Therefore, other explanations regarding the manufacturing method of the skin material 70 and the embossing apparatus 80 will be omitted.

EXAMPLE

In order to confirm the effectiveness of the synthetic leather 10 and the skin material 70, the inventor conducted an experiment using twelve types of synthetic leather and skin materials as samples. The twelve types of synthetic leather and skin materials are referred to as "Sample 1" to "Sample 12".

In the example, in order to clarify the correspondence with the embodiments described above, the reference numerals for the same or corresponding respective parts are the same as above. However, in the example, when the second porous resin layer does not contain the hollow particle 43, the reference numerals for the synthetic leather, the porous resin layer, the second porous resin layer, the hole, the second hole, and the skin material are "synthetic leather 15", "porous resin layer 35", "second porous resin layer 37", "hole 45", "second hole 47", and "skin material 75". In the synthetic leather 10 of FIG. 1 and the skin material 70 of FIG. 2, a plurality of hollow particles 43 is dispersed in the resin serving as the base material of the second porous resin layer 32. Based on this viewpoint, the second porous resin layer 37 is different from the second porous resin layer 32 shown in FIGS. 1 and 2, and the second holes 47 are different from the second holes 42 shown in FIGS. 1 and 2. In this case, the synthetic leather 15 is different from the synthetic leather 10 shown in FIGS. 1 and 2, and the porous resin layer 35 is different from the porous resin layer 30 shown in FIGS. 1 and 2, the holes 45 are different from the holes 40 shown in FIGS. 1 and 2, and the skin material 75 is different from the skin material 70 shown in FIG. 2. In the example (embodiment), illustrations of the synthetic leather 15 and the skin material 75 are omitted.

Experimental Method (1) Sample 1

(1-1) Synthetic Leather 10 of Sample 1 and Manufacturing Method Thereof.

The synthetic leather 10 of Sample 1 includes the fibrous base material 20, the porous resin layer 30, the non-porous resin layer 50, and the protective layer 60. The porous resin layer 30 includes the first porous resin layer 31 and the second porous resin layer 32. The fibrous base material 20, the first porous resin layer 31, the second porous resin layer 32, the non-porous resin layer 50, and the protective layer 60 are laminated in the order of the protective layer 60, the non-porous resin layer 50, the second porous resin layer 32, the first porous resin layer 31, and the fibrous base material 20 from the front side to the back side in the thickness direction. The fibrous base material 20 was a tricot knitted fabric of 28 gauges. This tricot knitted fabric is made of polyester fibers and has a thickness of 1.1 mm and a density of 0.03 g/cm$^3$. The method for manufacturing the synthetic leather 10 of Sample 1 was carried out in accordance with the second manufacturing method described above, and the steps A to D were carried out in the order of step C, step B, step A, and step D.

In step C, the composition liquid C prepared from the Formulation 1 described below was applied in the form of a sheet onto a release paper. As the release paper, AR-96M manufactured by Asahiroll Co., Ltd. was used. This release paper has a grained-like concavo-convex pattern on a coated surface. A comma coater was used to apply the composition liquid C. The coating amount of the composition liquid C was 35 g/m$^2$. In step C, after coating the composition liquid C, the composition liquid C was dried using a dryer. The drying condition was 100° C. for 3 minutes.

[Formulation 1]

Base material: 90 pts·mass (Water-based polycarbonate-based polyurethane resin, manufactured by LANXESS Corporation, BAYDERM Bottom DLV, solid content 40 mass %, softening temperature 200° C.)

Matting agent: 10 pts·mass (Silica-containing water-based polycarbonate-based urethane resin, manufactured by LANXESS Corporation, HYDRHOLAC UD-2, solid content 25 mass %)

Crosslinking agent: 1 pts·mass (Isocyanate-based crosslinking agent, manufactured by LANXESS Corporation, AQUADERM XL-50, solid content 50 mass %)

Pigment: 20 pts·mass (Carbon black-based black pigment, manufactured by LANXESS Corporation, EUDERM Black B-N, solid content 25 mass %)

Leveling agent: 1 pts·mass (Silicone-based leveling agent, manufactured by LANXESS Corporation, AQUADERM Fluid H, solid content 100 mass %)

Thickener: 3 pts·mass (Polyether polyol-based polyurethane polymer, manufactured by ADEKA Corporation, ADEKANOL UH-450VF, solid content 50 mass %)

Water: 20 pts·mass

In the preparation of Formulation 1, the viscosity of the composition liquid C was set to 5000 mPa·s using the thickener. To measure the viscosity, a B-type viscometer and a rotor of a rotor No. 4 were used. The rotation speed was 12 rpm. The measurement was conducted in an environment set at 23° C. Regarding the non-porous resin layer 50 formed in step C, the thickness T7 was 35 μm and the softening temperature was 210° C.

In step B, the composition liquid B prepared from the Formulation 2 described below was applied in the form of a sheet onto the first intermediate body formed in step C. The first intermediate body is formed by laminating the non-porous resin layer 50 on the release paper. The surface of the first intermediate body onto which the composition liquid B is applied is the back face of the non-porous resin layer 50. A comma coater was used to apply the composition liquid B. The coating amount of the composition liquid B was 45 g/m$^2$. In step B, after the composition liquid B was applied, the composition liquid B was dried using a dryer. The drying condition was 100° C. for 3 minutes.

[Formulation 2]

Base material: 100 pts·mass (Water-based polycarbonate-based polyurethane resin, manufactured by LANXESS Corporation, LCC Binder UB-1770, solid content 30 mass %, softening temperature 160° C.)

Hollow particle 43: 2.5 pts·mass (Foamed microcapsule, manufactured by Matsumoto Yushi-Seiyaku Co., Ltd., Matsumoto Microsphere FN-100S (used in a foamed state by heat treatment), average particle size 50 μm, solid content 100 mass %, powder form, outer shell: acrylonitrile polymer (softening temperature: 150° C.), inclusion: isopentane, foamed product)

Crosslinking agent: 1 pts·mass (Isocyanate-based crosslinking agent, manufactured by LANXESS Corporation, AQUADERM XL-50, solid content 50 mass %)

Leveling agent: 1 pts·mass (Silicone-based leveling agent, manufactured by LANXESS Corporation, AQUADERM Fluid H, solid content 100 mass %)

Thickener: 3 pts·mass (Polyether polyol-based polyurethane polymer, manufactured by ADEKA Corporation, ADEKANOL UH-450VF, solid content 50 mass %)

Water: 20 pts·mass

In the preparation of Formulation 2, the viscosity of the composition liquid B was set to 5000 mPa·s using the thickener. To measure the viscosity, the B-type viscometer and the rotor of the rotor No. 4 were used. The rotation speed was 12 rpm. The measurement was conducted in an environment set at 23° C. Regarding the second porous resin layer 32 formed in step B, the thickness T4 was 80 μm and the softening temperature was 140° C.

In step A, the composition liquid A prepared from the Formulation 3 described below was applied in the form of a sheet onto the second intermediate body formed in step B. The second intermediate body is formed by laminating the second porous resin layer 32 on the back side of the first intermediate body in the thickness direction. The surface of the second intermediate body onto which the composition liquid A is applied is the back face of the second porous resin layer 32. A knife coater was used to apply the composition liquid A. The coating amount of the composition liquid A was 180 g/m$^2$. In step A, after the composition liquid A was applied, the composition liquid A was dried using a dryer. The drying condition was 100° C. for 3 minutes. Subsequently, in step A, the first porous resin layer 31 and the fibrous base material 20 were pressure bonded in a state in which the composition liquid A after coating as the first porous resin layer 31 had viscosity. The pressurizing condition was 39.2 N/cm$^2$ for 1 minute. Next, in step A, the release paper was peeled off.

[Formulation 3]

Base material: 100 pts·mass (Polycarbonate polyol, manufactured by Kuraray Co., Ltd., Kuraray Polyol C2090, solid content 100 mass %)

Curing agent: 15 pts·mass (4.4'-diphenylmethane diisocyanate, manufactured by Seikoh Chemicals Co., Ltd., solid content 50 mass %)

Catalyst: 0.1 pts·mass (Phenol salt of DBU, manufactured by San-Apro, Ltd., U-CAT SA1, solid content 0.1 mass %)

Catalyst: 0.1 pts·mass (Para-toluene sulfonic acid of DBU, manufactured by San-Apro, Ltd., U-CAT SA50, solid content 0.1 mass %)

Solvent (methyl ethyl ketone): 40 pts·mass

In the preparation of Formulation 3, the viscosity of the composition liquid A was set to 5000 mPa·s using the solvent. To measure the viscosity, the B-type viscometer and the rotor of the rotor No. 4 were used. The rotation speed was 12 rpm. The measurement was conducted in an environment set at 23° C. Regarding the first porous resin layer 31 formed in step A, the thickness T1 was 200 μm and the softening temperature was 190° C.

In step D, the composition liquid D prepared from the Formulation 4 described below was applied in the form of a sheet onto the third intermediate body formed in step A. The third intermediate body is formed by laminating the non-porous resin layer 50, the second porous resin layer 32, the first porous resin layer 31, and the fibrous base material 20 from the front side to the back side in the thickness direction. The surface of the third intermediate body onto which the composition liquid D is applied is the front face of the non-porous resin layer 50. A reverse coater was used to apply the composition liquid D. The average coating thickness of composition liquid D was 5 μm (see "thickness T10" in FIG. 1). In step D, after the composition liquid D was applied, the composition liquid D was dried using a dryer. The drying condition was 100° C. for 3 minutes.

[Formulation 4]

Base material: 90 pts·mass (Water-based polycarbonate-based polyurethane resin, manufactured by LANXESS Corporation, BAYDERM Finish 61UD, solid content 35 mass %)

Matting agent: 10 pts·mass (Silica containing water-based polycarbonate-based urethane resin, manufactured by LANXESS Corporation, HYDRHOLAC UD-2, solid content 25 mass %)

Crosslinking agent: 1 pts·mass (Isocyanate-based crosslinking agent, manufactured by LANXESS Corporation, AQUADERM XL-50, solid content 50 mass %)

Leveling agent: 1 pts·mass (Silicone-based leveling agent, manufactured by LANXESS Corporation, AQUADERM Fluid H, solid content 100 mass %)

Thickener: 3 pts·mass (Acrylic acid alkyl ester methacrylic acid copolymer aqueous emulsion, manufactured by Seikoh Chemicals Co., Ltd., Luckcoat AD480, solid content 70 mass %)

Water: 20 pts·mass

In the preparation of Formulation 4, the viscosity of the composition liquid D was set to 200 mPa·s using the thickener. To measure the viscosity, the B-type viscometer and a rotor of a rotor No. 1 were used. The rotation speed was 12 rpm. The measurement was conducted in an environment set at 23° C.

The softening temperatures of the non-porous resin layer 50, second porous resin layer 32, and first porous resin layer 31 described above were measured in accordance with JIS K7196. The measurement was carried out using a thermomechanical analyzer (EXSTAR TMA-SS6100) manufactured by Hitachi High-Tech Science Corporation, and a needle-penetrating probe was used. The diameter of the needle tip was 1.0 mm.

When the softening temperature (first temperature) of the first porous resin layer 31, the softening temperature (second temperature) of the second porous resin layer 32, and the softening temperature (third temperature) of the non-porous resin layer 50, respectively were compared, the results were as follows. That is, the softening temperature (140° C.) of the second porous resin layer 32 was 50° C. lower than the softening temperature (190° C.) of the first porous resin layer 31. The softening temperature (210° C.) of the non-porous resin layer 50 was 20° C. higher than the softening temperature (190° C.) of the first porous resin layer 31, and was 70° C. higher than the softening temperature (140° C.) of the second porous resin layer 32.

(1-2) Skin Material 70 of Sample 1 and Manufacturing Method Thereof

The skin material 70 of Sample 1 is formed using the synthetic leather 10 of Sample 1 as a material. The skin material 70 of Sample 1 includes the synthetic leather 10 of Sample 1, and this synthetic leather 10 has the concavo-convex pattern 71 on the front face. In the skin material 70 of Sample 1, the plurality of hollow particles 43 is dispersed in the resin that serves as the base material of the second porous resin layer 32. In the method for manufacturing the skin material 70 of Sample 1, the embossing apparatus 80 shown in FIG. 3 was used. The specifications of the embossing apparatus 80 and embossing conditions were as follows. Regarding the "top surface of the convex portion 83", "vertical" corresponds to a diagonal distance of the hexagon, "horizontal" corresponds to a width across two flats of the hexagon, and "side" corresponds to a dimension of one side. Regarding the "arrangement of the plurality of convex portions 83", "circumferential direction" coincides with the rotation direction of the embossing die 81 and the opposite direction of the rotation direction, and "width direction" coincides with a direction of a rotation axis of the embossing die 81.

[Specifications of Embossing Apparatus 80]

Outer diameter of embossing die 81: 250 mm

Configuration of molding portion 82

- Shape of convex portion 83: Hexagonal column (top surface: hexagon, height: 3 mm)
- Top surface (vertical×horizontal×side): 4.6 mm×3.9 mm×2.3 mm
- Arrangement of plurality of convex portions 83: Arranged at intervals of 2.5 mm in the circumferential direction and the width direction Outer diameter of embossing receiving die 85: 350 mm

[Embossing Conditions]

Surface temperature of embossing die 81: 175° C.

Press force: 20 MPa

Conveyance speed: 0.3 m/min

The surface temperature of the embossing die 81 corresponds to the "heating temperature" in the above-described embodiment. That is, in the method for manufacturing the skin material 70 of Sample 1, the heating temperature (175° C.) was set 15° C. lower than the softening temperature (190° C.) of the first porous resin layer 31, was set 35° C. higher than the softening temperature (140° C.) of the second porous resin layer 32, and was set 35° C. lower than the softening temperature (210° C.) of the non-porous resin layer 50.

(2) Sample 2

(2-1) Synthetic Leather 10 of Sample 2 and Manufacturing Method Thereof

Sample 2 was the synthetic leather 10 similar to the synthetic leather 10 of Sample 1. The method for manufacturing the synthetic leather 10 of Sample 2 was carried out in accordance with the second manufacturing method described above, similar to the method for manufacturing the synthetic leather 10 of Sample 1. However, in step C, the composition liquid C was changed from the above-described Formulation 1 to the following Formulation 1-2.

[Formulation 1-2]

Base material: 95 pts·mass (Water-based polyester-based polyurethane resin, manufactured by DKS Co., Ltd., Superflex 460, solid content 38 mass %, softening temperature 152° C.)

Matting agent: 10 pts·mass (Silica-containing water-based polycarbonate-based urethane resin, manufactured by LANXESS Corporation, HYDRHOLAC UD-2, solid content 25 mass %)

Crosslinking agent: 1 pts·mass (Isocyanate-based crosslinking agent, manufactured by LANXESS Corporation, AQUADERM XL-50, solid content 50 mass %)

Pigment: 20 pts·mass (Carbon black-based black pigment, manufactured by LANXESS Corporation, EUDERM Black B-N, solid content 25 mass %)

Leveling agent: 1 pts·mass (Silicone-based leveling agent, manufactured by LANXESS Corporation, AQUADERM Fluid H, solid content 100 mass %)

Thickener: 3 pts·mass (Polyether polyol-based polyurethane polymer, manufactured by ADEKA Corporation, ADEKANOL UH-450VF, solid content 50 mass %)

Water: 20 pts·mass

In the preparation of Formulation 1-2, the viscosity of the composition liquid C was set to 5000 mPa·s using the thickener. To measure the viscosity, the B-type viscometer and the rotor of the rotor No. 4 were used. The rotation speed was 12 rpm. The measurement was conducted in an environment set at 23° C. Regarding the non-porous resin layer 50 formed in step C, the thickness T7 was 35 μm and the softening temperature was 152° C.

When the softening temperature (first temperature) of the first porous resin layer 31, the softening temperature (second temperature) of the second porous resin layer 32, and the softening temperature (third temperature) of the non-porous resin layer 50, respectively were compared, the results were as follows. That is, the softening temperature (140° C.) of the second porous resin layer 32 was 50° C. lower than the softening temperature (190° C.) of the first porous resin layer 31. The softening temperature (152° C.) of the non-porous resin layer 50 was 38° C. lower than the softening temperature (190° C.) of the first porous resin layer 31, and was 12° C. higher than the softening temperature (140° C.) of the second porous resin layer 32.

The difference between Samples 1 and 2 is the point described above. In addition, the synthetic leather 10 of Sample 2 and its manufacturing method were the same as those of Sample 1. Therefore, other explanations regarding the synthetic leather 10 of Sample 2 and its manufacturing method will be omitted.

(2-2) Skin Material 70 of Sample 2 and Manufacturing Method Thereof

The skin material 70 of Sample 2 is formed using the synthetic leather 10 of Sample 2 as a material. The skin material 70 of Sample 2 has the same structure as the skin material 70 of Sample 1. In the method for manufacturing the skin material 70 of Sample 2, the specifications of the embossing apparatus 80 and the embossing conditions were the same as those of Sample 1. That is, in the method for manufacturing the skin material 70 of Sample 2, the heating temperature (175° C.) was set 15° C. lower than the softening temperature (190° C.) of the first porous resin layer 31, was set 35° C. higher than the softening temperature (140° C.) of the second porous resin layer 32, and was set 23° C. higher than the softening temperature (152° C.) of the non-porous resin layer 50.

The difference between Samples 1 and 2 is the point described above. In addition, the method for manufacturing the skin material 70 of Sample 2 was the same as that of Sample 1. Therefore, other explanations regarding the skin material 70 of Sample 2 and its manufacturing method will be omitted.

(3) Sample 3

(3-1) Synthetic Leather 10 of Sample 3 and Manufacturing Method Thereof

Sample 3 was the synthetic leather 10 similar to the synthetic leather 10 of Sample 1. The method for manufacturing the synthetic leather 10 of Sample 3 was carried out in accordance with the second manufacturing method described above, similarly to the method for manufacturing the synthetic leather 10 of Sample 1. However, in step B, the coating amount of the composition liquid B was changed from 45 g/m$^2$ to 68 g/m$^2$. Regarding the second porous resin layer 32 formed in step B, the thickness T4 was 120 μm and the softening temperature was 140° C.

When the softening temperature (first temperature) of the first porous resin layer 31, the softening temperature (second temperature) of the second porous resin layer 32, and the softening temperature (third temperature) of the non-porous resin layer 50, respectively were compared, the results were as follows. That is, the softening temperature (140° C.) of the second porous resin layer 32 was 50° C. lower than the softening temperature (190° C.) of the first porous resin layer 31. The softening temperature (210° C.) of the non-porous resin layer 50 was 20° C. higher than the softening temperature (190° C.) of the first porous resin layer 31, and was 70° C. higher than the softening temperature (140° C.) of the second porous resin layer 32.

The difference between Samples 1 and 3 is the point described above. In addition, the synthetic leather 10 of Sample 3 and its manufacturing method were the same as those of Sample 1. Therefore, other explanations regarding the synthetic leather 10 of Sample 3 and its manufacturing method will be omitted.

(3-2) Skin Material 70 of Sample 3 and Manufacturing Method Thereof

The skin material 70 of Sample 3 is formed using the synthetic leather 10 of Sample 3 as a material. The skin material 70 of Sample 3 has the same structure as the skin material 70 of Sample 1. In the method for manufacturing the skin material 70 of Sample 3, the specifications of the embossing apparatus 80 and the embossing conditions were the same as those of Sample 1. That is, in the method for manufacturing the skin material 70 of Sample 3, the heating temperature (175° C.) was set 15° C. lower than the softening temperature (190° C.) of the first porous resin layer 31, was set 35° C. higher than the softening temperature (140° C.) of the second porous resin layer 32, and was set 35° C. lower than the softening temperature (210° C.) of the non-porous resin layer 50.

The difference between Samples 1 and 3 is the point described above. In addition, the method for manufacturing the skin material 70 of Sample 3 was the same as that of Sample 1. Therefore, other explanations regarding the skin material 70 of Sample 3 and its manufacturing method will be omitted.

(4) Sample 4

(4-1) Synthetic Leather 10 of Sample 4 and Manufacturing Method Thereof

Sample 4 was the synthetic leather 10 similar to the synthetic leather 10 of Sample 1. The method for manufacturing the synthetic leather 10 of Sample 4 was carried out in accordance with the second manufacturing method described above, similar to the method for manufacturing the synthetic leather 10 of Sample 1. However, in step B, the composition liquid B was changed from the above-described Formulation 2 to the following Formulation 2-2, and the coating amount of the composition liquid B was changed from 45 g/m$^2$ to 68 g/m$^2$.

[Formulation 2-2]

Base material: 100 pts·mass (Water-based polycarbonate-based polyurethane resin, manufactured by LANXESS Corporation, LCC Binder UB-1770, solid content 30 mass %, softening temperature 160° C.)

Hollow particle 43: 2.5 pts·mass (Foamed microcapsule, manufactured by Matsumoto Yushi-Seiyaku Co., Ltd., Matsumoto Microsphere F-80DE, average particle size 110 μm, solid content 100 mass %, powder form, outer shell: Acrylonitrile polymer (softening temperature: 160° C.), inclusion: Isopentane, foamed product)

Crosslinking agent: 1 pts·mass (Isocyanate-based crosslinking agent, manufactured by LANXESS Corporation, AQUADERM XL-50, solid content 50 mass %)

Leveling agent: 1 pts·mass (Silicone-based leveling agent, manufactured by LANXESS Corporation, AQUADERM Fluid H, solid content 100 mass %)

Thickener: 3 pts·mass (Polyether polyol-based polyurethane polymer, manufactured by ADEKA Corporation, ADEKANOL UH-450VF, solid content 50 mass %)

Water: 20 pts·mass

In the preparation of Formulation 2-2, the viscosity of the composition liquid B was set to 5000 mPa·s using the thickener. To measure the viscosity, the B-type viscometer and the rotor of the rotor No. 4 were used. The rotation speed was 12 rpm. The measurement was conducted in an environment set at 23° C. Regarding the second porous resin layer 32 formed in step B, the thickness T4 was 110 μm and the softening temperature was 140° C.

In addition, in step A, the composition liquid A was changed from the above-described Formulation 3 to the following Formulation 3-2, and the coating amount of the composition liquid A was changed from 180 g/m$^2$ to 200 g/m$^2$. Furthermore, in step A, the drying conditions after the composition liquid A was applied changed from 100° C. for 3 minutes to 70° C. for 8 minutes.

[Formulation 3-2]

Base material: 100 pts·mass (Polycarbonate polyol, manufactured by Kuraray Co., Ltd., Kuraray Polyol C2090, solid content 100 mass %)

Curing agent: 15 pts·mass (4.4'-diphenylmethane diisocyanate, manufactured by Seikoh Chemicals Co., Ltd., solid content 50 mass %)

Catalyst: 0.1 pts·mass (Phenol salt of DBU, manufactured by San-Apro, Ltd., U-CAT SA1, solid content 0.1 mass %)

Catalyst: 0.1 pts·mass (Para-toluene sulfonic acid of DBU, manufactured by San-Apro, Ltd., U-CAT SA50, solid content 0.1 mass %)

Solvent (methyl ethyl ketone): 60 pts·mass

In the preparation of Formulation 3-2, the viscosity of the composition liquid A was set to 3000 mPa·s using the solvent. To measure the viscosity, the B-type viscometer and the rotor of the rotor No. 4 were used. The rotation speed was 12 rpm. The measurement was conducted in an environment set at 23° C. Regarding the first porous resin layer 31 formed in step A, the thickness T1 was 200 μm and the softening temperature was 190° C.

When the softening temperature (first temperature) of the first porous resin layer 31, the softening temperature (second temperature) of the second porous resin layer 32, and the softening temperature (third temperature) of the non-porous resin layer 50, respectively were compared, the results were as follows. That is, the softening temperature (140° C.) of the second porous resin layer 32 was 50° C. lower than the softening temperature (190° C.) of the first porous resin layer 31. The softening temperature (210° C.) of the non-porous resin layer 50 was 20° C. higher than the softening temperature (190° C.) of the first porous resin layer 31, and was 70° C. higher than the softening temperature (140° C.) of the second porous resin layer 32.

The difference between Samples 1 and 4 is the point described above. In addition, the synthetic leather 10 of Sample 4 and its manufacturing method were the same as those of Sample 1. Therefore, other explanations regarding the synthetic leather 10 of Sample 4 and its manufacturing method will be omitted.

(4-2) Skin Material 70 of Sample 4 and Manufacturing Method Thereof

The skin material 70 of Sample 4 is formed using the synthetic leather 10 of Sample 4 as a material. The skin material 70 of Sample 4 has the same structure as the skin material 70 of Sample 1. In the method for manufacturing the skin material 70 of Sample 4, the specifications of the embossing apparatus 80 and the embossing conditions were the same as those of Sample 1. That is, in the method for manufacturing the skin material 70 of Sample 4, the heating temperature (175° C.) was set 15° C. lower than the softening temperature (190° C.) of the first porous resin layer 31, was set 35° C. higher than the softening temperature (140° C.) of the second porous resin layer 32, and was set 35° C. lower than the softening temperature (210° C.) of the non-porous resin layer 50.

The difference between Samples 1 and 4 is the point described above. In addition, the method for manufacturing the skin material 70 of Sample 4 was the same as that of Sample 1. Therefore, other explanations regarding the skin material 70 of Sample 4 and its manufacturing method will be omitted.

(5) Sample 5

(5-1) Synthetic Leather 10 of Sample 5 and Manufacturing Method Thereof

Sample 5 was the synthetic leather 10 similar to the synthetic leather 10 of Sample 1. The method for manufacturing the synthetic leather 10 of Sample 5 was carried out in accordance with the second manufacturing method described above, similar to the method for manufacturing the synthetic leather 10 of Sample 1. However, in step B, the composition liquid B was changed from the above-described Formulation 2 to the following Formulation 2-3.

[Formulation 2-3]

Base material: 100 pts·mass (Water-based polycarbonate-based polyurethane resin, manufactured by DIC Corporation, WLS-290SG, solid content 30 mass %, softening temperature 220° C.)

Hollow particle 43: 2.5 pts·mass (Foamed microcapsule, manufactured by Matsumoto Yushi-Seiyaku Co., Ltd., Matsumoto Microsphere FN-100S (Used in a foamed state through heat treatment), average particle size 50 μm, solid content 100 mass %, powder form, outer shell: Acrylonitrile polymer (softening temperature: 150° C.), inclusion: Isopentane, foamed product)

Crosslinking agent: 1 pts·mass (Isocyanate-based crosslinking agent, manufactured by LANXESS Corporation, AQUADERM XL-50, solid content 50 mass %)

Leveling agent: 1 pts·mass (Silicone-based leveling agent, manufactured by LANXESS Corporation, AQUADERM Fluid H, solid content 100 mass %)

Thickener: 3 pts·mass (Polyether polyol-based polyurethane polymer, manufactured by ADEKA Corporation, ADEKANOL UH-450VF, solid content 50 mass %)

Water: 20 pts·mass

In the preparation of Formulation 2-3, the viscosity of the composition liquid B was set to 5000 mPa·s using the thickener. To measure the viscosity, the B-type viscometer and the rotor of the rotor No. 4 were used. The rotation speed was 12 rpm. The measurement was conducted in an environment set at 23° C. Regarding the second porous resin layer 32 formed in step B, the thickness T4 was 80 μm and the softening temperature was 220° C.

When the softening temperature (first temperature) of the first porous resin layer 31, the softening temperature (second temperature) of the second porous resin layer 32, and the softening temperature (third temperature) of the non-porous resin layer 50, respectively were compared, the results were as follows. That is, the softening temperature (220° C.) of the second porous resin layer 32 was 30° C. higher than the softening temperature (190° C.) of the first porous resin layer 31. The softening temperature (210° C.) of the non-porous resin layer 50 was 20° C. higher than the softening temperature (190° C.) of the first porous resin layer 31, and was 10° C. lower than the softening temperature (220° C.) of the second porous resin layer 32.

The difference between Samples 1 and 5 is the point described above. In addition, the synthetic leather 10 of Sample 5 and its manufacturing method were the same as those of Sample 1. Therefore, other explanations regarding the synthetic leather 10 of Sample 5 and its manufacturing method will be omitted.

(5-2) Skin Material 70 of Sample 5 and Manufacturing Method Thereof

The skin material 70 of Sample 5 is formed using the synthetic leather 10 of Sample 5 as a material. The skin material 70 of Sample 5 has the same structure as the skin material 70 of Sample 1. In the method for manufacturing the skin material 70 of Sample 5, the specifications of the embossing apparatus 80 and the embossing conditions were the same as those of Sample 1. That is, in the method for manufacturing the skin material 70 of Sample 5, the heating temperature (175° C.) was set 15° C. lower than the softening temperature (190° C.) of the first porous resin layer 31, was set 45° C. lower than the softening temperature (220° C.) of the second porous resin layer 32, and was set 35° C. lower than the softening temperature (210° C.) of the non-porous resin layer 50.

The difference between Samples 1 and 5 is the point described above. In addition, the method for manufacturing the skin material 70 of Sample 5 was the same as that of Sample 1. Therefore, other explanations regarding the skin material 70 of Sample 5 and its manufacturing method will be omitted.

(6) Sample 6

(6-1) Synthetic Leather 10 of Sample 6 and Manufacturing Method Thereof

Sample 6 was the synthetic leather 10 similar to the synthetic leather 10 of Sample 1. The method for manufacturing the synthetic leather 10 of Sample 6 was carried out in accordance with the second manufacturing method described above, similar to the method for manufacturing the synthetic leather 10 of Sample 1. However, in step B, the composition liquid B was changed from the above-described Formulation 2 to the following Formulation 2-4.

[Formulation 2-4]

Base material: 79 pts·mass (Water-based polycarbonate-based polyurethane resin, manufactured by DKS Co. Ltd., Superflex 470, solid content 38 mass %, softening temperature 97° C.)

Hollow particle 43: 2.5 pts·mass (Foamed microcapsule, manufactured by Matsumoto Yushi-Seiyaku Co., Ltd., Matsumoto Microsphere FN-100S (Used in a foamed state through heat treatment), average particle size 50 μm, solid content 100 mass %, powder form, outer shell: Acrylonitrile polymer (softening temperature: 150° C.), inclusion: Isopentane, foamed product)

Crosslinking agent: 1 pts·mass (Isocyanate-based crosslinking agent, manufactured by LANXESS Corporation, AQUADERM XL-50, solid content 50 mass %)

Leveling agent: 1 pts·mass (Silicone-based leveling agent, manufactured by LANXESS Corporation, AQUADERM Fluid H, solid content 100 mass %)

Thickener: 3 pts·mass (Polyether polyol-based polyurethane polymer, manufactured by ADEKA Corporation, ADEKANOL UH-450VF, solid content 50 mass %)

Water: 20 pts·mass

In the preparation of Formulation 2-4, the viscosity of the composition liquid B was set to 5000 mPa·s using the thickener. To measure the viscosity, the B-type viscometer and the rotor of the rotor No. 4 were used. The rotation speed was 12 rpm. The measurement was conducted in an environment set at 23° C. Regarding the second porous resin layer 32 formed in step B, the thickness T4 was 80 μm and the softening temperature was 97° C.

When the softening temperature (first temperature) of the first porous resin layer 31, the softening temperature (second temperature) of the second porous resin layer 32, and the softening temperature (third temperature) of the non-porous resin layer 50, respectively were compared, the results were as follows. That is, the softening temperature (97° C.) of the second porous resin layer 32 was 93° C. lower than the softening temperature (190° C.) of the first porous resin layer 31. The softening temperature (210° C.) of the non-porous resin layer 50 was 20° C. higher than the softening temperature (190° C.) of the first porous resin layer 31, and was 113° C. higher than the softening temperature (97° C.) of the second porous resin layer 32.

The difference between Samples 1 and 6 is the point described above. In addition, the synthetic leather 10 of Sample 6 and its manufacturing method were the same as those of Sample 1. Therefore, other explanations regarding the synthetic leather 10 of Sample 6 and its manufacturing method will be omitted.

(6-2) Skin Material 70 of Sample 6 and Manufacturing Method Thereof

The skin material 70 of Sample 6 is formed using the synthetic leather 10 of Sample 6 as a material. The skin material 70 of Sample 6 has the same structure as the skin material 70 of Sample 1. In the method for manufacturing the skin material 70 of Sample 6, the specifications of the embossing apparatus 80 and the embossing conditions were the same as those of Sample 1. That is, in the method for manufacturing the skin material 70 of Sample 6, the heating temperature (175° C.) was set 15° C. lower than the softening temperature (190° C.) of the first porous resin layer 31, was set 78° C. higher than the softening temperature (97° C.) of the second porous resin layer 32, and was set 35° C. lower than the softening temperature (210° C.) of the non-porous resin layer 50.

The difference between Samples 1 and 6 is the point described above. In addition, the method for manufacturing the skin material 70 of Sample 6 was the same as that of Sample 1. Therefore, other explanations regarding the skin material 70 of Sample 6 and its manufacturing method will be omitted.

(7) Sample 7

(7-1) Synthetic Leather 10 of Sample 7 and Manufacturing Method Thereof

Sample 7 was the synthetic leather 10 similar to the synthetic leather 10 of Sample 1. The method for manufacturing the synthetic leather 10 of Sample 7 was carried out in accordance with the second manufacturing method described above, similar to the method for manufacturing the synthetic leather 10 of Sample 1. However, in step B, the composition liquid B was changed from the above-described Formulation 2 to the following Formulation 2-5.

[Formulation 2-5]

Base material: 79 pts·mass (Water-based polycarbonate-based polyurethane resin, manufactured by DKS Co. Ltd., F-2405D, solid content 38 mass %, softening temperature 120° C.)

Hollow particle 43: 2.5 pts·mass (Foamed microcapsule, manufactured by Matsumoto Yushi-Seiyaku Co., Ltd., Matsumoto Microsphere FN-100S (Used in a foamed state through heat treatment), average particle size 50 μm, solid content 100 mass %, powder form, outer shell: Acrylonitrile polymer (softening temperature: 150° C.), inclusion: Isopentane, foamed product)

Crosslinking agent: 1 pts·mass (Isocyanate-based crosslinking agent, manufactured by LANXESS Corporation, AQUADERM XL-50, solid content 50 mass %)

Leveling agent: 1 pts·mass (Silicone-based leveling agent, manufactured by LANXESS Corporation, AQUADERM Fluid H, solid content 100 mass %)

Thickener: 3 pts·mass (Polyether polyol-based polyurethane polymer, manufactured by ADEKA Corporation, ADEKANOL UH-450VF, solid content 50 mass %)

Water: 20 pts·mass

In the preparation of Formulation 2-5, the viscosity of the composition liquid B was set to 5000 mPa·s using the thickener. To measure the viscosity, the B-type viscometer and the rotor of the rotor No. 4 were used. The rotation speed was 12 rpm. The measurement was conducted in an environment set at 23° C. Regarding the second porous resin layer 32 formed in step B, the thickness T4 was 80 μm and the softening temperature was 120° C.

When the softening temperature (first temperature) of the first porous resin layer 31, the softening temperature (second temperature) of the second porous resin layer 32, and the softening temperature (third temperature) of the non-porous resin layer 50, respectively were compared, the results were as follows. That is, the softening temperature (120° C.) of the second porous resin layer 32 was 70° C. lower than the softening temperature (190° C.) of the first porous resin layer 31. The softening temperature (210° C.) of the non-porous resin layer 50 was 20° C. higher than the softening temperature (190° C.) of the first porous resin layer 31, and was 90° C. higher than the softening temperature (120° C.) of the second porous resin layer 32.

The difference between Samples 1 and 7 is the point described above. In addition, the synthetic leather 10 of Sample 7 and its manufacturing method were the same as those of Sample 1. Therefore, other explanations regarding the synthetic leather 10 of Sample 7 and its manufacturing method will be omitted.

(7-2) Skin Material 70 of Sample 7 and Manufacturing Method Thereof

The skin material 70 of Sample 7 is formed using the synthetic leather 10 of Sample 7 as a material. The skin material 70 of Sample 7 has the same structure as the skin material 70 of Sample 1. In the method for manufacturing the skin material 70 of Sample 7, the specifications of the embossing apparatus 80 and the embossing conditions were the same as those of Sample 1. That is, in the method for manufacturing the skin material 70 of Sample 7, the heating temperature (175° C.) was set 15° C. lower than the softening temperature (190° C.) of the first porous resin layer 31, was set 55° C. higher than the softening temperature (120° C.) of the second porous resin layer 32, and was set 35° C. lower than the softening temperature (210° C.) of the non-porous resin layer 50.

The difference between Samples 1 and 7 is the point described above. In addition, the method for manufacturing the skin material 70 of Sample 7 was the same as that of Sample 1. Therefore, other explanations regarding the skin material 70 of Sample 7 and its manufacturing method will be omitted.

(8) Sample 8

(8-1) Synthetic Leather 10 of Sample 8 and Manufacturing Method Thereof

Sample 8 was the synthetic leather 10 similar to the synthetic leather 10 of Sample 1. The method for manufacturing the synthetic leather 10 of Sample 8 was carried out in accordance with the second manufacturing method described above, similar to the method for manufacturing the synthetic leather 10 of Sample 1. However, in step B, the composition liquid B was changed from the above-described Formulation 2 to the following Formulation 2-6.

[Formulation 2-6]

Base material: 54 pts·mass (Water-based polycarbonate-based polyurethane resin, manufactured by DIC Corporation, WLA-195AR, solid content 56 mass %, softening temperature 166° C.)

Hollow particle 43: 2.5 pts·mass (Foamed microcapsule, manufactured by Matsumoto Yushi-Seiyaku Co., Ltd., Matsumoto Microsphere FN-100S (Used in a foamed state through heat treatment), average particle size 50 μm, solid content 100 mass %, powder form, outer shell: Acrylonitrile polymer (softening temperature: 150° C.), inclusion: Isopentane, foamed product)

Crosslinking agent: 1 pts·mass (Isocyanate-based crosslinking agent, manufactured by LANXESS Corporation, AQUADERM XL-50, solid content 50 mass %)

Leveling agent: 1 pts·mass (Silicone-based leveling agent, manufactured by LANXESS Corporation, AQUADERM Fluid H, solid content 100 mass %)

Thickener: 3 pts·mass (Polyether polyol-based polyurethane polymer, manufactured by ADEKA Corporation, ADEKANOL UH-450VF, solid content 50 mass %)

Water: 20 pts·mass

In the preparation of Formulation 2-6, the viscosity of the composition liquid B was set to 5000 mPa·s using the thickener. To measure the viscosity, the B-type viscometer and the rotor of the rotor No. 4 were used. The rotation speed was 12 rpm. The measurement was conducted in an environment set at 23° C. Regarding the second porous resin layer 32 formed in step B, the thickness T4 was 80 μm and the softening temperature was 166° C.

When the softening temperature (first temperature) of the first porous resin layer 31, the softening temperature (second temperature) of the second porous resin layer 32, and the softening temperature (third temperature) of the non-porous resin layer 50, respectively were compared, the results were as follows. That is, the softening temperature (166° C.) of the second porous resin layer 32 was 24° C. lower than the softening temperature (190° C.) of the first porous resin layer 31. The softening temperature (210° C.) of the non-porous resin layer 50 was 20° C. higher than the softening temperature (190° C.) of the first porous resin layer 31, and was 44° C. higher than the softening temperature (166° C.) of the second porous resin layer 32.

The difference between Samples 1 and 8 is the point described above. In addition, the synthetic leather 10 of Sample 8 and its manufacturing method were the same as those of Sample 1. Therefore, other explanations regarding the synthetic leather 10 of Sample 8 and its manufacturing method will be omitted.

(8-2) Skin Material 70 of Sample 8 and Manufacturing Method Thereof

The skin material 70 of Sample 8 is formed using the synthetic leather 10 of Sample 8 as a material. The skin material 70 of Sample 8 has the same structure as the skin material 70 of Sample 1. In the method for manufacturing the skin material 70 of Sample 8, the specifications of the embossing apparatus 80 and the embossing conditions were the same as those of Sample 1. That is, in the method for manufacturing the skin material 70 of Sample 8, the heating temperature (175° C.) was set 15° C. lower than the softening temperature (190° C.) of the first porous resin layer 31, was set 9° C. higher than the softening temperature (166° C.) of the second porous resin layer 32, and was set 35° C. lower than the softening temperature (210° C.) of the non-porous resin layer 50.

The difference between Samples 1 and 8 is the point described above. In addition, the method for manufacturing the skin material 70 of Sample 8 was the same as that of Sample 1. Therefore, other explanations regarding the skin material 70 of Sample 8 and its manufacturing method will be omitted.

(9) Sample 9

(9-1) Synthetic Leather 10 of Sample 9 and Manufacturing Method Thereof

Sample 9 was the synthetic leather 10 similar to the synthetic leather 10 of Sample 1. The method for manufacturing the synthetic leather 10 of Sample 9 was carried out in accordance with the second manufacturing method described above, similar to the method for manufacturing the synthetic leather 10 of Sample 1. However, in step B, the composition liquid B was changed from the above-described Formulation 2 to the following Formulation 2-7.

[Formulation 2-7]

Base material: 56 pts·mass (Water-based polycarbonate-based polyurethane resin, manufactured by DIC Corporation, CRS-1701, solid content 54 mass %, softening temperature 180° C.)

Hollow particle 43: 2.5 pts·mass (Foamed microcapsule, manufactured by Matsumoto Yushi-Seiyaku Co., Ltd., Matsumoto Microsphere FN-100S (Used in a foamed state through heat treatment), average particle size 50 μm, solid content 100 mass %, powder form, outer shell: Acrylonitrile polymer (softening temperature: 150° C.), inclusion: Isopentane, foamed product)

Crosslinking agent: 1 pts·mass (Isocyanate-based crosslinking agent, manufactured by LANXESS Corporation, AQUADERM XL-50, solid content 50 mass %)

Leveling agent: 1 pts·mass (Silicone-based leveling agent, manufactured by LANXESS Corporation, AQUADERM Fluid H, solid content 100 mass %)

Thickener: 3 pts·mass (Polyether polyol-based polyurethane polymer, manufactured by ADEKA Corporation, ADEKANOL UH-450VF, solid content 50 mass %)

Water: 20 pts·mass

In the preparation of Formulation 2-7, the viscosity of the composition liquid B was set to 5000 mPa·s using the thickener. To measure the viscosity, the B-type viscometer and the rotor of the rotor No. 4 were used. The rotation speed was 12 rpm. The measurement was conducted in an environment set at 23° C. Regarding the second porous resin layer 32 formed in step B, the thickness T4 was 80 μm and the softening temperature was 180° C.

When the softening temperature (first temperature) of the first porous resin layer 31, the softening temperature (second temperature) of the second porous resin layer 32, and the softening temperature (third temperature) of the non-porous resin layer 50, respectively were compared, the results were as follows. That is, the softening temperature (180° C.) of the second porous resin layer 32 was 10° C. lower than the softening temperature (190° C.) of the first porous resin layer 31. The softening temperature (210° C.) of the non-porous resin layer 50 was 20° C. higher than the softening temperature (190° C.) of the first porous resin layer 31, and was 30° C. higher than the softening temperature (180° C.) of the second porous resin layer 32.

The difference between Samples 1 and 9 is the point described above. In addition, the synthetic leather 10 of Sample 9 and its manufacturing method were the same as those of Sample 1. Therefore, other explanations regarding the synthetic leather 10 of Sample 9 and its manufacturing method will be omitted.

(9-2) Skin Material 70 of Sample 9 and Manufacturing Method Thereof

The skin material 70 of Sample 9 is formed using the synthetic leather 10 of Sample 9 as a material. The skin material 70 of Sample 9 has the same structure as the skin material 70 of Sample 1. In the method for manufacturing the skin material 70 of Sample 9, the specifications of the embossing apparatus 80 and the embossing conditions were the same as those of Sample 1. That is, in the method for manufacturing the skin material 70 of Sample 9, the heating temperature (175° C.) was set 15° C. lower than the softening temperature (190° C.) of the first porous resin layer 31, was set 5° C. lower than the softening temperature (180° C.) of the second porous resin layer 32, and was set 35° C. lower than the softening temperature (210° C.) of the non-porous resin layer 50.

The difference between Samples 1 and 9 is the point described above. In addition, the method for manufacturing the skin material 70 of Sample 9 was the same as that of Sample 1. Therefore, other explanations regarding the skin material 70 of Sample 9 and its manufacturing method will be omitted.

(10) Sample 10

(10-1) Synthetic Leather 10 of Sample 10 and Manufacturing Method Thereof

In the synthetic leather 10 of Sample 10, the protective layer 60 is omitted. The synthetic leather 10 of Sample 10 includes the fibrous base material 20, the porous resin layer 30, and the non-porous resin layer 50. The porous resin layer 30 includes the first porous resin layer 31 and the second porous resin layer 32. The fibrous base material 20, the first porous resin layer 31, the second porous resin layer 32, and the non-porous resin layer 50 are laminated in the order of the non-porous resin layer 50, the second porous resin layer 32, the first porous resin layer 31, and the fibrous base material 20 from the front side to the back side in the thickness direction. The method for manufacturing the synthetic leather 10 of Sample 10 was carried out in accordance with the second manufacturing method described above, and the steps A to C were carried out in the order of step C, step B, and step A. Step D was not implemented due to the omission of the protective layer 60.

When the softening temperature (first temperature) of the first porous resin layer 31, the softening temperature (second temperature) of the second porous resin layer 32, and the softening temperature (third temperature) of the non-porous resin layer 50, respectively were compared, the results were as follows. That is, the softening temperature (140° C.) of the second porous resin layer 32 was 50° C. lower than the softening temperature (190° C.) of the first porous resin layer 31. The softening temperature (210° C.) of the non-porous resin layer 50 was 20° C. higher than the softening temperature (190° C.) of the first porous resin layer 31, and was 70° C. higher than the softening temperature (140° C.) of the second porous resin layer 32.

The difference between Samples 1 and 10 is the point described above. In addition, the synthetic leather 10 of Sample 10 and its manufacturing method were the same as those of Sample 1. Therefore, other explanations regarding the synthetic leather 10 of Sample 10 and its manufacturing method will be omitted.

(10-2) Skin Material 70 of Sample 10 and Manufacturing Method Thereof

The skin material 70 of Sample 10 is formed using the synthetic leather 10 of Sample 10 as a material. The skin material 70 of Sample 10 has the same structure as the skin material 70 of Sample 1, except the point that the protective layer 60 is not included. In the method for manufacturing the skin material 70 of Sample 10, the specifications of the embossing apparatus 80 and the embossing conditions were the same as those of Sample 1. That is, in the method for manufacturing the skin material 70 of Sample 10, the heating temperature (175° C.) was set 15° C. lower than the softening temperature (190° C.) of the first porous resin layer 31, was set 35° C. higher than the softening temperature (140° C.) of the second porous resin layer 32, and was set 35° C. lower than the softening temperature (210° C.) of the non-porous resin layer 50.

The difference between Samples 1 and 10 is the point described above. In addition, the method for manufacturing the skin material 70 of Sample 10 was the same as that of Sample 1. Therefore, other explanations regarding the skin material 70 of Sample 10 and its manufacturing method will be omitted.

(11) Sample 11

(11-1) Synthetic Leather 10 of Sample 11 and Manufacturing Method Thereof

Sample 11 was the synthetic leather 10 similar to the synthetic leather 10 of Sample 1. The method for manufacturing the synthetic leather 10 of Sample 11 was carried out in accordance with the second manufacturing method described above, similar to the method for manufacturing the synthetic leather 10 of Sample 1. However, in step A, the composition liquid A was changed from the above-described Formulation 3 to the following Formulation 3-3.

[Formulation 3-3]

Base material: 100 pts·mass (Solvent-based yellowing-resistant polycarbonate polyol, manufactured by DIC Corporation, SAD-30, solid content 70 mass %)

Hollow particle 43: 4.76 pts·mass (Foamed microcapsule, manufactured by Matsumoto Yushi-Seiyaku Co., Ltd., Matsumoto Microsphere FN-100SD (Used in a foamed state through heat treatment), average particle size 50 μm, solid content 100 mass %, powder form, outer shell: Acrylonitrile polymer (softening temperature: 160° C.), inclusion: Isopentane, foamed product)

Curing agent: 10.5 pts·mass (4.4'-diphenylmethane diisocyanate, manufactured by Seikoh Chemicals Co., Ltd., solid content 50 mass %)

Solvent (methyl ethyl ketone): 42 pts·mass

In the preparation of Formulation 3-3, the viscosity of the composition liquid A was set to 5000 mPa·s using the solvent. To measure the viscosity, the B-type viscometer and the rotor of the rotor No. 4 were used. The rotation speed was 12 rpm. The measurement was conducted in an environment set at 23° C. Regarding the first porous resin layer 31 formed in step A, the thickness T1 was 200 μm and the softening temperature was 190° C.

When the softening temperature (first temperature) of the first porous resin layer 31, the softening temperature (second temperature) of the second porous resin layer 32, and the softening temperature (third temperature) of the non-porous resin layer 50, respectively were compared, the results were as follows. That is, the softening temperature (140° C.) of the second porous resin layer 32 was 50° C. lower than the softening temperature (190° C.) of the first porous resin layer 31. The softening temperature (210° C.) of the non-porous resin layer 50 was 20° C. higher than the softening temperature (190° C.) of the first porous resin layer 31, and was 70° C. higher than the softening temperature (140° C.) of the second porous resin layer 32.

The difference between Samples 1 and 11 is the point described above. In addition, the synthetic leather 10 of Sample 11 and its manufacturing method were the same as those of Sample 1. Therefore, other explanations regarding the synthetic leather 10 of Sample 11 and its manufacturing method will be omitted.

(11-2) Skin Material 70 of Sample 11 and Manufacturing Method Thereof

The skin material 70 of Sample 11 is formed using the synthetic leather 10 of Sample 11 as a material. The skin material 70 of Sample 11 has the same structure as the skin material 70 of Sample 1. In the method for manufacturing the skin material 70 of Sample 11, the specifications of the embossing apparatus 80 and the embossing conditions were the same as those of Sample 1. That is, in the method for manufacturing the skin material 70 of Sample 11, the heating temperature (175° C.) was set 15° C. lower than the softening temperature (190° C.) of the first porous resin layer 31, was set 35° C. higher than the softening temperature (140° C.) of the second porous resin layer 32, and was set 35° C. lower than the softening temperature (210° C.) of the non-porous resin layer 50.

The difference between Samples 1 and 11 is the point described above. In addition, the method for manufacturing skin material 70 of Sample 11 was the same as that of Sample 1. Therefore, other explanations regarding the skin material 70 of Sample 11 and its manufacturing method will be omitted.

(12) Sample 12

(12-1) Synthetic Leather 15 of Sample 12 and Manufacturing Method Thereof

Sample 12 was the synthetic leather 15 having a different structure from the synthetic leather 10 of Sample 1. The synthetic leather 15 of Sample 12 includes the fibrous base material 20, the porous resin layer 35, the non-porous resin layer 50, and the protective layer 60. The porous resin layer 35 includes the first porous resin layer 31 and the second porous resin layer 37. The fibrous base material 20, the first porous resin layer 31, the second porous resin layer 37, the non-porous resin layer 50, and the protective layer 60 are laminated in the order of the protective layer 60, the non-porous resin layer 50, the second porous resin layer 37, the first porous resin layer 31, and the fibrous base material 20 from the front side to the back side in the thickness direction. The second porous resin layer 37 has the plurality of second holes 47. The plurality of second holes 47 is a part of the plurality of holes 45 that the porous resin layer 35 has. However, the second hole 47 is not formed by the hollow particle 43. That is, in the synthetic leather 15 of Sample 12, the plurality of hollow particles 43 is not dispersed in the resin that serves as the base material of the second porous resin layer 37. In the synthetic leather 15 of Sample 12, similar to the plurality of first holes 41 in the first porous resin layer 31, the plurality of second holes 47 was formed in the resin serving as the base material of the second porous resin layer 37 by known foam molding (mechanical foaming).

The method for manufacturing the synthetic leather 15 of Sample 12 was carried out in accordance with the second manufacturing method described above, similar to the method for manufacturing the synthetic leather 10 of Sample 1. In step B, the composition liquid B was changed from the above-described Formulation 2 to the following Formulation 2-8.

[Formulation 2-8]

Base material: 100 pts·mass (Water-based polycarbonate-based polyurethane resin, manufactured by LANXESS Corporation, LCC Binder UB-1770, solid content 30 mass %, softening temperature 160° C.)

Crosslinking agent: 1 pts·mass (Isocyanate-based crosslinking agent, manufactured by LANXESS Corporation, AQUADERM XL-50, solid content 50 mass %)

Leveling agent: 1 pts·mass (Silicone-based leveling agent, manufactured by LANXESS Corporation, AQUADERM Fluid H, solid content 100 mass %)

Thickener: 6 pts·mass (Polyether polyol-based polyurethane polymer, manufactured by ADEKA Corporation, ADEKANOL UH-450VF, solid content 50 mass %)

Water: 20 pts·mass

In the preparation of Formulation 2-8, the viscosity of the composition liquid B was set to 10000 mPa·s using the thickener. To measure the viscosity, the B-type viscometer and the rotor of the rotor No. 4 were used. The rotation speed was 12 rpm. The measurement was conducted in an environment set at 23° C. Regarding the second porous resin layer 37 formed in step B, the thickness T4 was 80 μm and the softening temperature was 140° C.

When the softening temperature (first temperature) of the first porous resin layer 31, the softening temperature (second temperature) of the second porous resin layer 37, and the softening temperature (third temperature) of the non-porous resin layer 50, respectively were compared, the results were as follows. That is, the softening temperature (140° C.) of the second porous resin layer 37 was 50° C. lower than the softening temperature (190° C.) of the first porous resin layer 31. The softening temperature (210° C.) of the non-porous resin layer 50 was 20° C. higher than the softening temperature (190° C.) of the first porous resin layer 31, and was 70° C. higher than the softening temperature (140° C.) of the second porous resin layer 37.

The difference between Samples 1 and 12 is the point described above. In addition, the synthetic leather 15 of Sample 12 and its manufacturing method were the same as those of Sample 1. Therefore, other explanations regarding the synthetic leather 15 of Sample 12 and its manufacturing method will be omitted.

(12-2) Skin Material 75 of Sample 12 and Manufacturing Method Thereof

The skin material 75 of Sample 12 is formed using the synthetic leather 15 of Sample 12 as a material. The skin material 75 of Sample 12 includes the synthetic leather 15 of Sample 12, and this synthetic leather 15 has the concavo-concave pattern 71 on a front face. In the skin material 75 of Sample 12, the plurality of hollow particles 43 is not dispersed in the resin serving as the base material of the second porous resin layer 37. In the method for manufacturing the skin material 75 of Sample 12, the specifications of the embossing apparatus 80 and the embossing conditions were the same as those of Sample 1. That is, in the method for manufacturing the skin material 75 of Sample 12, the heating temperature (175° C.) was set 15° C. lower than the softening temperature (190° C.) of the first porous resin layer 31, was set 35° C. higher than the softening temperature (140° C.) of the second porous resin layer 37, and was set 35° C. lower than the softening temperature (210° C.) of the non-porous resin layer 50.

The difference between Samples 1 and 12 is the point described above. In addition, the method for manufacturing the skin material 75 of Sample 12 was the same as that of Sample 1. Therefore, other explanations regarding the skin material 75 of Sample 12 and its manufacturing method will be omitted.

(13) Evaluation 1

The appearance of the concavo-convex pattern 71 was visually observed and evaluated according to the following evaluation criteria. In this evaluation 1, a case in which the evaluation result was grade 4 or higher was considered to be a pass.

[Evaluation Criteria for Appearance of Concavo-Convex Pattern 71]

Grade 5: There is a clear sense unevenness and has excellent sharpness at the boundary line.

Grade 4: There is a clear sense of unevenness, but the sharpness at the boundary line is slightly lacking.

Grade 3: There is a feeling of unevenness, but the sharpness at the boundary line is lacking.

Grade 2: A sense of unevenness is slightly unclear.

Grade 1: A sense of unevenness is unclear.

(14) Evaluation 2

A thickness difference ΔT was evaluated according to the following evaluation criteria. The thickness difference ΔT is a difference (TB-TA) between the thickness TA of the concave portion 72 and the thickness TB of the convex portion 73 (see FIG. 2). The thickness TA of the concave portion 72 was an average value of the following three first measurement values. The three first measurement values are obtained by measuring arbitrary three concave portions 72 of the concavo-convex pattern 71. The thickness TB of the convex portion 73 was an average value of the following three second measurement values. The three second measurement values are obtained by measuring arbitrary three convex portions 73 of the concavo-convex pattern 71. The thickness TA of the concave portion 72 and the thickness TB of the convex portion 73 were measured by magnifying the vertical cross section of the skin materials 70 and 75 at 500 times using a microscope (VHX-200/100F) manufactured by Keyence Corporation. The cutting direction of the skin materials 70 and 75 coincides with the thickness direction. In this evaluation 2, a case in which the evaluation result was B or higher was considered to be a pass.

[Evaluation Criteria for Thickness Difference ΔT]

A: 85 μm or more

B: 60 μm or more and less than 85 μm

C: less than 60 μm

Experiment Results (1) Evaluation 1 and Evaluation 2

The evaluation results of Evaluation 1 and Evaluation 2 are shown in Table 1.

TABLE 1

| EVALUATION RESULT | SAMPLE 1 | 2 | 3 | 4 | 5 | 6 | 7 | 8 | 9 | 10 | 11 | 12 |
|---|---|---|---|---|---|---|---|---|---|---|---|---|
| EVALUATION 1 (GRADE) | 5 | 5 | 4 | 5 | 4 | 5 | 5 | 5 | 4 | 5 | 5 | 3 |
| EVALUATION 2 | A | A | A | B | B | A | A | A | B | A | A | A |

For the skin materials 70 of Samples 1 to 11, the evaluation results for Evaluation 1 were Grade 4 or higher, and the evaluation results for Evaluation 2 were B or higher. That is, the skin materials 70 of Samples 1 to 11 all satisfied the criteria for passing Evaluation 1 and the criteria for passing Evaluation 2.

On the other hand, for the skin material 75 of Sample 12, the evaluation result of Evaluation 2 was A, but the evaluation result of Evaluation 1 was grade 3. That is, the skin material 75 of Sample 12 satisfied the criteria for passing Evaluation 2, but did not satisfy the criteria for passing Evaluation 1. In the synthetic leather 15 of Sample 12, the second porous resin layer 37 includes the plurality of second holes 47 by mechanical foaming the resin that serves as the base material of the second porous resin layer 37. The inventor thinks that even in the synthetic leather 15 of Sample 12, by including the plurality of second holes 47 in the second porous resin layer 37, it will be possible to form the concavo-convex pattern 71 with an evaluation result of A in the evaluation 2. However, the inventor thinks that sharpness could not be imparted to the concavo-convex pattern 71 due to the following first reason and second reason. The first reason is that it is impossible or difficult to make the sizes of the plurality of second holes 47 uniform by foam molding such as mechanical foaming. The second reason is that it is impossible or difficult to distribute and arrange the plurality of second holes 47 throughout the second porous resin layer 37. As a result, the inventor thinks that the evaluation result of Evaluation 1 for the skin material 75 of Sample 12 was grade 3.

Based on the results of this experiment, by comparing with the plurality of second holes 47 in the second porous resin layer 37 of Sample 12, the inventor presumes that the second porous resin layers 32 of Samples 1 to 11 can facilitate the realization of the following phenomenon. The previously mentioned phenomenon is that the plurality of second holes 42 is uniformly distributed and arranged throughout the second porous resin layer 32 by the plurality of hollow particles 43.

(2) Others

Figure 4:
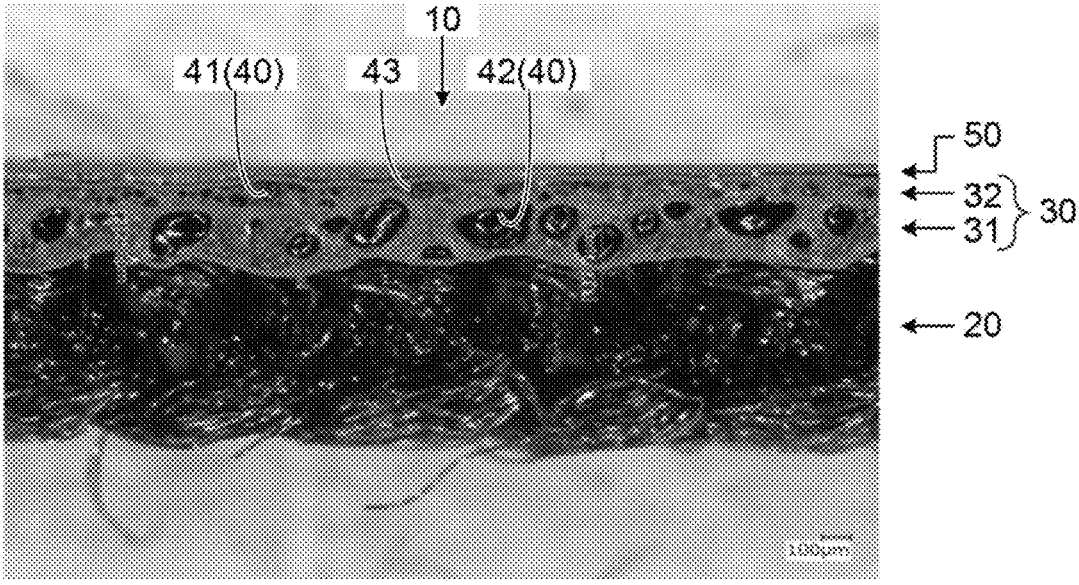
FIG. 4 are photographs of vertical cross sections of the synthetic leather and the skin material. The upper row shows the synthetic leather of Sample 1 used as a sample in the example, and shows the state before embossing. The lower row shows the skin material of Sample 1 used as a sample in the example. The cutting direction of the synthetic leather in the upper row and the skin material in the lower row coincides with a thickness direction.
Figure 4:
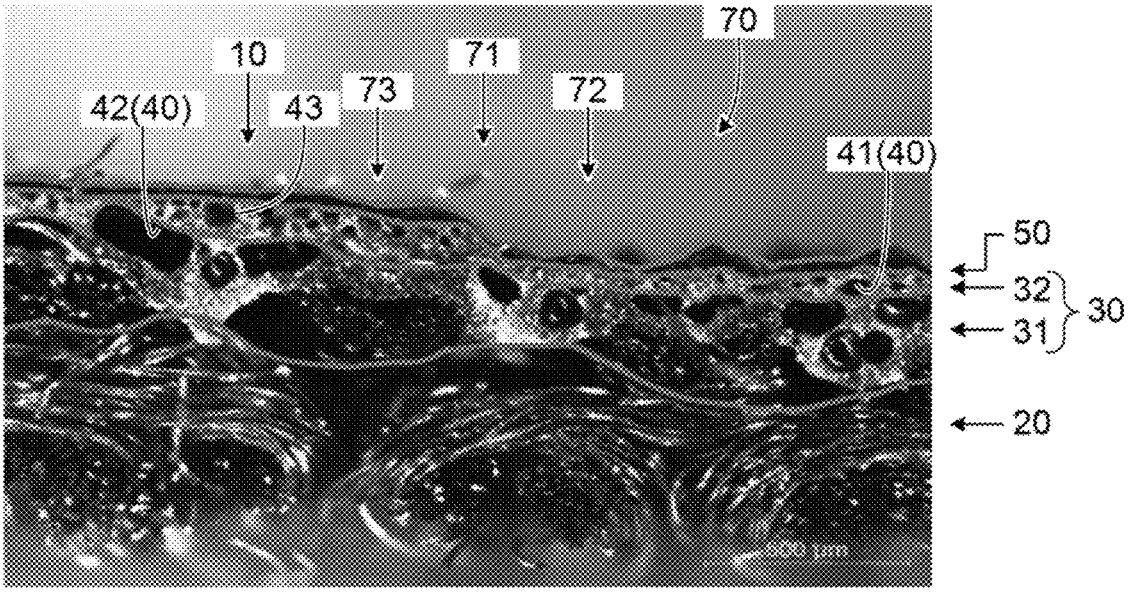
Figure 4:
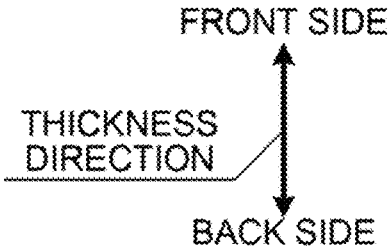

For example, the synthetic leather 10 of Sample 1 had the aspect shown in the upper row of FIG. 4, and the skin material 70 of Sample 1 had the aspect shown in the lower row of FIG. 4. In the upper and lower rows of FIG. 4, which target the synthetic leather 10 and skin material 70 of sample 1, solid lines are drawn overlapping the following boundaries and are drawn overlapping the front face of the synthetic leather 10 to clarify them. The previously mentioned boundaries are a boundary between the fibrous base material 20 and the first porous resin layer 31, a boundary between the first porous resin layer 31 and the second porous resin layer 32, and a boundary between the second porous resin layer 32 and the non-porous resin layer 50. In the upper and lower rows of FIG. 4, the protective layer 60 cannot be observed. This is because the magnification of the vertical cross section in the upper and lower rows of FIG. 4 was set to 300 times.

For reference, the results obtained from the synthetic leathers 10 and the skin materials 70 of Samples 1 to 11 and the synthetic leather 15 and the skin material 75 of Sample 12 are summarized in Tables 2 to 9. The "first dimension (A)", "first dimension (B)" and "first dimension (C)" in Tables 2 to 5, and "Second dimension (A)", "second dimension (B)" and "second dimension (C)" in Tables 6 to 9 are as follows. That is, the first dimension (A) indicates the long diameter of the first hole 41 in the synthetic leather 10 and 15 before embossing. The first dimension (B) indicates the long diameter of the first hole 41 in the area of the concave portion 72 of the concavo-convex pattern 71. The first dimension (C) indicates the long diameter of the first hole 41 in the area of the convex portion 73 of the concavo-convex pattern 71. The second dimension (A) indicates the long diameter of the second holes 42 and 47 in the synthetic leather 10 and 15 before embossing. The second dimension (B) indicates the long diameter of the second holes 42 and 47 in the area of the concave portion 72 of the concavo-convex pattern 71. The second dimension (C) indicates the long diameter of the second holes 42 and 47 in the area of the convex portion 73 of the concavo-convex pattern 71.

TABLE 2

| STRUCTURE | MEASUREMENT ITEM | SAMPLE 1 | 2 | 3 |
|---|---|---|---|---|
| FIBROUS BASE MATERIAL (20) | THICKNESS (mm) | 1.1 | 1.1 | 1.1 |
| FIRST POROUS RESIN LAYER (31) | FIRST DIMENSION (A) (μm) | 200 | 200 | 200 |
| | FIRST DIMENSION (B) (μm) | 100 | 100 | 100 |
| | FIRST DIMENSION (C) (μm) | 200 | 200 | 200 |
| | THICKNESS (T1) (μm) | 200 | 200 | 200 |
| | THICKNESS (T2) (μm) | 164 | 164 | 164 |
| | THICKNESS (T3) (μm) | 200 | 200 | 200 |
| | COMPRESSIBILITY (%) | 18 | 18 | 18 |
| | SOFTENING TEMPERATURE (° C.) | 190 | 190 | 190 |
| HOLLOW PARTICLE OUTER SHELL | | — | — | — |

TABLE 3

| STRUCTURE | MEASUREMENT ITEM | SAMPLE 4 | 5 | 6 |
|---|---|---|---|---|
| FIBROUS BASE MATERIAL (20) | THICKNESS (mm) | 1.1 | 1.1 | 1.1 |
| FIRST POROUS RESIN LAYER (31) | FIRST DIMENSION (A) (μm) | 100 | 200 | 200 |
| | FIRST DIMENSION (B) (μm) | 50 | 100 | 100 |
| | FIRST DIMENSION (C) (μm) | 100 | 200 | 200 |
| | THICKNESS (T1) (μm) | 200 | 200 | 200 |
| | THICKNESS (T2) (μm) | 182 | 164 | 164 |
| | THICKNESS (T3) (μm) | 200 | 200 | 200 |
| | COMPRESSIBILITY (%) | 9 | 18 | 18 |
| | SOFTENING TEMPERATURE (° C.) | 190 | 190 | 190 |
| HOLLOW PARTICLE OUTER SHELL | | — | — | — |

TABLE 4

| STRUCTURE | MEASUREMENT ITEM | SAMPLE 7 | 8 | 9 |
|---|---|---|---|---|
| FIBROUS BASE MATERIAL (20) | THICKNESS (mm) | 1.1 | 1.1 | 1.1 |
| FIRST POROUS RESIN LAYER (31) | FIRST DIMENSION (A) (μm) | 200 | 200 | 200 |
| | FIRST DIMENSION (B) (μm) | 100 | 100 | 100 |
| | FIRST DIMENSION (C) (μm) | 200 | 200 | 200 |
| | THICKNESS (T1) (μm) | 200 | 200 | 200 |
| | THICKNESS (T2) (μm) | 164 | 164 | 164 |
| | THICKNESS (T3) (μm) | 200 | 200 | 200 |
| | COMPRESSIBILITY (%) | 18 | 18 | 18 |
| | SOFTENING TEMPERATURE (° C.) | 190 | 190 | 190 |
| HOLLOW PARTICLE OUTER SHELL | | — | — | — |

TABLE 4-continued

| STRUCTURE | MEASUREMENT ITEM | SAMPLE 7 | 8 | 9 |
|---|---|---|---|---|
| | THICKNESS (T3) (μm) | 200 | 200 | 200 |
| | COMPRESSIBILITY (%) | 18 | 18 | 18 |
| | SOFTENING TEMPERATURE (° C.) | 190 | 190 | 190 |
| HOLLOW PARTICLE OUTER SHELL | | — | — | — |

TABLE 5

| STRUCTURE | MEASUREMENT ITEM | SAMPLE 10 | 11 | 12 |
|---|---|---|---|---|
| FIBROUS BASE MATERIAL (20) | THICKNESS (mm) | 1.1 | 1.1 | 1.1 |
| FIRST POROUS RESIN LAYER (31) | FIRST DIMENSION (A) (μm) | 200 | 200 | 200 |
| | FIRST DIMENSION (B) (μm) | 100 | 100 | 100 |
| | FIRST DIMENSION (C) (μm) | 200 | 200 | 200 |
| | THICKNESS (T1) (μm) | 200 | 200 | 200 |
| | THICKNESS (T2) (μm) | 164 | 164 | 164 |
| | THICKNESS (T3) (μm) | 200 | 200 | 200 |
| | COMPRESSIBILITY (%) | 18 | 18 | 18 |
| | SOFTENING TEMPERATURE (° C.) | 190 | 190 | 190 |
| HOLLOW PARTICLE OUTER SHELL | | — | 160 | — |

TABLE 6

| STRUCTURE | MEASUREMENT ITEM | SAMPLE 1 | 2 | 3 |
|---|---|---|---|---|
| SECOND POROUS RESIN LAYER (32) | SECOND DIMENSION (A) (μm) | 80 | 80 | 80 |
| | SECOND DIMENSION (B) (μm) | 40 | 40 | 40 |
| | SECOND DIMENSION (C) (μm) | 75 | 75 | 75 |
| | THICKNESS (T4) (μm) | 80 | 80 | 120 |
| | THICKNESS (T5) (μm) | 40 | 40 | 80 |
| | THICKNESS (T6) (μm) | 80 | 80 | 120 |
| | COMPRESSIBILITY (%) | 50 | 50 | 33 |
| | SOFTENING TEMPERATURE (° C.) | 140 | 140 | 140 |
| HOLLOW PARTICLE (43) OUTER SHELL | SOFTENING TEMPERATURE (° C.) | 150 | 150 | 150 |
| NON-POROUS RESIN LAYER (50) | THICKNESS (T7) (μm) | 35 | 35 | 35 |
| | THICKNESS (T8) (μm) | 20 | 10 | 20 |
| | THICKNESS (T9) (μm) | 35 | 35 | 35 |
| | COMPRESSIBILITY (%) | 22 | 71 | 22 |
| | SOFTENING TEMPERATURE (° C.) | 210 | 152 | 210 |
| PROTECTIVE LAYER (60) | THICKNESS (T10) (μm) | 5 | 5 | 5 |

TABLE 7

| STRUCTURE | MEASUREMENT ITEM | SAMPLE 4 | 5 | 6 |
|---|---|---|---|---|
| SECOND POROUS RESIN LAYER (32) | SECOND DIMENSION (A) (μm) | 110 | 80 | 80 |
| | SECOND DIMENSION (B) (μm) | 60 | 50 | 30 |
| | SECOND DIMENSION (C) (μm) | 105 | 75 | 75 |
| | THICKNESS (T4) (μm) | 110 | 80 | 80 |
| | THICKNESS (T5) (μm) | 60 | 50 | 30 |
| | THICKNESS (T6) (μm) | 110 | 80 | 80 |
| | COMPRESSIBILITY (%) | 50 | 37 | 62 |
| | SOFTENING TEMPERATURE (° C.) | 140 | 220 | 97 |
| HOLLOW PARTICLE (43) | SOFTENING TEMPERATURE (° C.) | 160 | 150 | 150 |
| OUTER SHELL NON-POROUS RESIN LAYER (50) | THICKNESS (T7) (μm) | 35 | 35 | 35 |
| | THICKNESS (T8) (μm) | 20 | 20 | 20 |
| | THICKNESS (T9) (μm) | 35 | 35 | 35 |
| | COMPRESSIBILITY (%) | 22 | 22 | 22 |
| | SOFTENING TEMPERATURE (° C.) | 210 | 210 | 210 |
| PROTECTIVE LAYER (60) | THICKNESS (T10) (μm) | 5 | 5 | 5 |

TABLE 8

| STRUCTURE | MEASUREMENT ITEM | SAMPLE 7 | 8 | 9 |
|---|---|---|---|---|
| SECOND POROUS RESIN LAYER (32) | SECOND DIMENSION (A) (μm) | 80 | 80 | 80 |
| | SECOND DIMENSION (B) (μm) | 40 | 40 | 50 |
| | SECOND DIMENSION (C) (μm) | 75 | 75 | 75 |
| | THICKNESS (T4) (μm) | 80 | 80 | 80 |
| | THICKNESS (T5) (μm) | 40 | 40 | 50 |
| | THICKNESS (T6) (μm) | 80 | 80 | 80 |
| | COMPRESSIBILITY (%) | 50 | 50 | 37 |
| | SOFTENING TEMPERATURE (° C.) | 120 | 166 | 180 |
| HOLLOW PARTICLE (43) | SOFTENING TEMPERATURE (° C.) | 150 | 150 | 150 |
| OUTER SHELL NON-POROUS RESIN LAYER (50) | THICKNESS (T7) (μm) | 35 | 35 | 35 |
| | THICKNESS (T8) (μm) | 20 | 20 | 20 |
| | THICKNESS (T9) (μm) | 35 | 35 | 35 |
| | COMPRESSIBILITY (%) | 22 | 22 | 22 |
| | SOFTENING TEMPERATURE (° C.) | 210 | 210 | 210 |
| PROTECTIVE LAYER (60) | THICKNESS (T10) (μm) | 5 | 5 | 5 |

TABLE 9

| STRUCTURE | MEASUREMENT ITEM | SAMPLE 10 | 11 | 12 |
|---|---|---|---|---|
| SECOND POROUS RESIN LAYER (32, 37) | SECOND DIMENSION (A) (μm) | 80 | 80 | 80 |
| | SECOND DIMENSION (B) (μm) | 40 | 40 | 40 |
| | SECOND DIMENSION (C) (μm) | 75 | 75 | 75 |

TABLE 9-continued

| STRUCTURE | MEASUREMENT ITEM | SAMPLE 10 | 11 | 12 |
|---|---|---|---|---|
| | THICKNESS (T4) (μm) | 80 | 80 | 80 |
| | THICKNESS (T5) (μm) | 40 | 40 | 40 |
| | THICKNESS (T6) (μm) | 80 | 80 | 80 |
| | COMPRESSIBILITY (%) | 50 | 50 | 50 |
| | SOFTENING TEMPERATURE (° C.) | 140 | 140 | 140 |
| HOLLOW PARTICLE (43) | SOFTENING TEMPERATURE (° C.) | 150 | 150 | — |
| OUTER SHELL NON-POROUS RESIN LAYER (50) | THICKNESS (T7) (μm) | 35 | 35 | 35 |
| | THICKNESS (T8) (μm) | 20 | 20 | 20 |
| | THICKNESS (T9) (μm) | 35 | 35 | 35 |
| | COMPRESSIBILITY (%) | 22 | 22 | 22 |
| | SOFTENING TEMPERATURE (° C.) | 210 | 210 | 210 |
| PROTECTIVE LAYER (60) | THICKNESS (T10) (μm) | — | 5 | 5 |

In the synthetic leathers 10 and skin materials 70 of Samples 1 to 11, and the synthetic leather 15 and skin material 75 of Sample 12, the relationship between the first dimension (A) and the second dimension (A), the relationship between the first dimension (B) and the second dimension (B), the relationship between the first dimension (C) and the second dimension (C), the relationship between the second dimension (B) and the second dimension (C) are as shown in Table 10. In Table 10, "Yes" indicates that the magnitude relationship is satisfied, and "No" indicates that the magnitude relationship is not satisfied. Based on the results of this experiment, the inventor thinks that the synthetic leathers 10 of Samples 1 to 11 have excellent formability.

TABLE 10

| RELATIONSHIP | SAMPLE 1 | 2 | 3 | 4 | 5 | 6 |
|---|---|---|---|---|---|---|
| First Dimension (A) > Second Dimension (A) | Yes | Yes | Yes | No | Yes | Yes |
| First Dimension (A) − Second Dimension (A) (μm) | 120 | 120 | 120 | −10 | 120 | 120 |
| First Dimension (B) > Second Dimension (B) | Yes | Yes | Yes | No | Yes | Yes |
| First Dimension (B) − Second Dimension (B) (μm) | 60 | 60 | 60 | −10 | 50 | 70 |
| First Dimension (C) > Second Dimension (C) | Yes | Yes | Yes | No | Yes | Yes |
| First Dimension (C) − Second Dimension (C) (μm) | 125 | 125 | 125 | −5 | 125 | 125 |
| Second Dimension (C) > Second Dimension (B) | Yes | Yes | Yes | Yes | Yes | Yes |
| Second Dimension (C) − Second Dimension (B) (μm) | 35 | 35 | 35 | 45 | 25 | 45 |

| RELATIONSHIP | SAMPLE 7 | 8 | 9 | 10 | 11 | 12 |
|---|---|---|---|---|---|---|
| First Dimension (A) > Second Dimension (A) | Yes | Yes | Yes | Yes | Yes | Yes |
| First Dimension (A) − Second Dimension (A) (μm) | 120 | 120 | 120 | 120 | 120 | 120 |
| First Dimension (B) > Second Dimension (B) | Yes | Yes | Yes | Yes | Yes | Yes |
| First Dimension (B) − Second Dimension (B) (μm) | 60 | 60 | 50 | 60 | 60 | 60 |
| First Dimension (C) > Second Dimension (C) | Yes | Yes | Yes | Yes | Yes | Yes |

TABLE 10-continued

| | | | | | | |
|---|---|---|---|---|---|---|
| First Dimension (C) – Second Dimension (C) (μm) | 125 | 125 | 125 | 125 | 125 | 125 |
| Second Dimension (C) > Second Dimension (B) | Yes | Yes | Yes | Yes | Yes | Yes |
| Second Dimension (C) – Second Dimension (B) (μm) | 35 | 35 | 25 | 35 | 35 | 35 |

Effects of Embodiment

According to the embodiment, the following effects can be obtained.

(1) Synthetic leather 10 includes the fibrous base material 20 and the porous resin layer 30 (see FIG. 1). The porous resin layer 30 is laminated on the fibrous base material 20 and has the plurality of holes 40. The porous resin layer 30 includes the first porous resin layer 31 and the second porous resin layer 32. The first porous resin layer 31 is laminated on the fibrous base material 20. The second porous resin layer 32 is laminated on the first porous resin layer 31. The first porous resin layer 31 has the plurality of first holes 41 which is a part of the plurality of holes 40. The second porous resin layer 32 has the plurality of second holes 42 which is a part of the plurality of holes 40. The porous resin layer 30 contains the plurality of hollow particles 43 in the following resin. The previously mentioned resin serves the base material of the porous resin layer 30 and the base material of the second porous resin layer 32. The plurality of hollow particles 43 is dispersed in the resin that serves as the base material of the second porous resin layer 32. The hollow particle 43 has second hole 42 inside.

According to the synthetic leather 10, the sizes of the plurality of second holes 42 can be made uniform. The plurality of second holes 42 having a uniform size can be dispersed in the second porous resin layer 32 laminated on the first porous resin layer 31.

Assume a synthetic leather as a comparative example. The synthetic leather of the comparative example includes the first porous resin layer 31, and further includes a porous resin layer of the comparative example on the front side of the first porous resin layer 31 in the thickness direction. The porous resin layer of the comparative example corresponds to the second porous resin layer 32. However, unlike the second porous resin layer 32, a plurality of holes of different sizes is dispersed in the porous resin layer of the comparative example. For convenience of explanation, a portion of the porous resin layer of the comparative example that includes large holes is referred to as a "first portion", and a portion of the porous resin layer of the comparative example that includes small holes is referred to as a "second portion". The second portion is provided in a direction perpendicular to the thickness direction with respect to the first portion. The size of the hole may be defined by the long diameter of the hole. When the synthetic leather of the comparative example is embossed, the entire porous resin layer of the comparative example is pressed with the same force. However, a difference in the amount of deformation tends to occur between the first portion and the second portion. According to the synthetic leather 10, occurrence of such a phenomenon can be suppressed.

When embossing the synthetic leather 10, the second porous resin layer 32 can be uniformly deformed. In the synthetic leather 10, the shape of the boundary lines of the concavo-convex pattern 71 can be a sharp shape. For example, the boundary lines of the concavo-convex pattern 71 corresponds to portions P1 and P2 within the concavo-convex pattern 71 (see FIG. 2). The portions P1 and P2 are formed by two non-parallel surfaces contacting each other and have angular shapes. The portion P1 serving as the boundary lines has a convex angular shape. The portion P2 serving as the boundary lines has a concave angular shape. However, the portions P1 and P2 are examples of the boundary lines of the concavo-convex pattern 71.

(2) The first hole 41 is a closed space having the long diameter of the first dimension, and the second hole 42 is a closed space having the long diameter of the second dimension (see FIG. 1). The relationship between the first dimension and the second dimension is preferably "first dimension>second dimension". The softening temperature of the first porous resin layer 31 is the first temperature, and the softening temperature of the second porous resin layer 32 is the second temperature. The relationship between the first temperature and the second temperature is preferably "first temperature>second temperature". According to these structures, when embossing the synthetic leather 10, the second porous resin layer 32 can be more easily deformed than the first porous resin layer 31.

(3) The skin material 70 includes the synthetic leather 10 (see FIG. 2). The synthetic leather 10 has the concavo-convex pattern 71 on its front face. According to this skin material 70, the synthetic leather 10 exhibits the above-described functions when embossing. The skin material 70 has the concavo-convex pattern 71 having the boundary lines in a sharp shape.

Modified Example

Embodiments can also be as follows. Some of the structures of the modified examples shown below can also be adopted in combination as appropriate. Below, points different from described above will be explained, and explanations of similar points will be omitted as appropriate.

(1) The synthetic leather 10 includes the fibrous base material 20, the porous resin layer 30, the non-porous resin layer 50, and the protective layer 60 (see FIG. 1). The porous resin layer 30 includes the first porous resin layer 31 and the second porous resin layer 32. The skin material 70 includes the synthetic leather 10 (see FIG. 2). The synthetic leather 10 as the skin material 70 has the concavo-convex pattern 71 on its front face. One or both of the non-porous resin layer 50 and the protective layer 60 may be omitted. In this explanation, correspondence with the embodiment based on FIGS. 1 and 2 will be made clear by using the reference numerical used above. Even if one or both of the non-porous resin layer 50 and the protective layer 60 omitted in the synthetic leather 10, in the porous resin layer 30, the second porous resin layer 32 is provided on the front side in the thickness direction than the first porous resin layer 31.

Assume that the non-porous resin layer 50 is omitted. In this case, the synthetic leather 10 includes the fibrous base material 20, the porous resin layer 30, and the protective layer 60 (not shown). In this synthetic leather 10, the fibrous base material 20, the porous resin layer 30, and the protective layer 60 are laminated in the order of the protective layer 60, the porous resin layer 30, and the fibrous base material 20 from the front side to the back side in the thickness direction. In the manufacturing method of this synthetic leather 10, step C is omitted. Step C forms the non-porous resin layer 50. The skin material 70 includes the synthetic leather 10 in which the non-porous resin layer 50 is omitted (not shown). The synthetic leather 10 of this skin material 70 has the concavo-convex pattern 71 on its front face.

Figure 5:
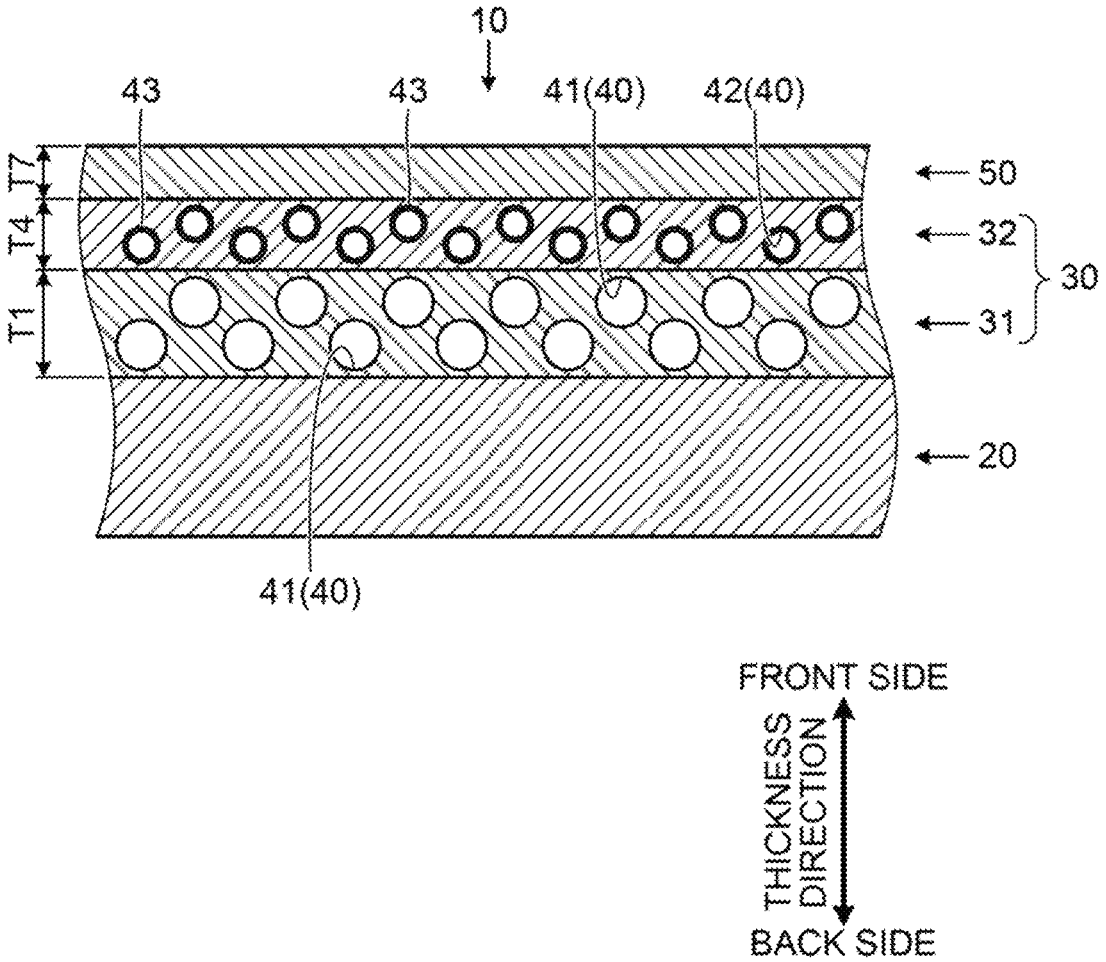
FIG. 5 is a cross-sectional view showing another example of a schematic structure of the synthetic leather. The synthetic leather shows a state before embossing.

Assume that the protective layer 60 is omitted (see "Sample 10" in the above-described embodiment). In this case, the synthetic leather 10 includes the fibrous base material 20, the porous resin layer 30, and the non-porous resin layer 50 (see FIG. 5). In this synthetic leather 10, the fibrous base material 20, the porous resin layer 30, and the non-porous resin layer 50 are laminated in the order of the non-porous resin layer 50, the porous resin layer 30, and the fibrous base material 20 from the front side to the back side in the thickness direction. In the manufacturing method of this synthetic leather 10, step D is omitted. Step D forms the protective layer 60. The skin material 70 includes the synthetic leather 10 in which the protective layer 60 omitted (see FIG. 6). The synthetic leather 10 of this skin material 70 has the concavo-convex pattern 71 on its front face.

Assume that the non-porous resin layer 50 and the protective layer 60 are omitted. In this case, the synthetic leather 10 includes the fibrous base material 20 and the porous resin layer 30 (not shown). In this synthetic leather 10, the fibrous base material 20 and the porous resin layer 30 are laminated in the order of the porous resin layer 30 and the fibrous base material 20 from the front side to the back side in the thickness direction. In the manufacturing method of this synthetic leather 10, Step C and Step D are omitted. Step C forms the non-porous resin layer 50. Step D forms the protective layer 60. The skin material 70 includes the synthetic leather 10 in which the non-porous resin layer 50 and the protective layer 60 are omitted (not shown). The synthetic leather 10 of this skin material 70 has the concavo-convex pattern 71 on its front face.

(2) The porous resin layer 30 includes the first porous resin layer 31 and the second porous resin layer 32 (see FIG. 1). The porous resin layer may be a single layer body. In this case, the porous resin layer which is a single layer body has the same structure as the second porous resin layer 32. That is, like the porous resin layer 30 described above, this porous resin layer is laminated on the fibrous base material 20 and has a plurality of holes. The porous resin layer, which is a single layer body, contains a plurality of hollow particles in the resin that serves as the base material of this porous resin layer. The plurality of hollow particles is dispersed in this resin. That is, in the porous resin layer which is a single layer body, the plurality of holes formed by the plurality of hollow particles is dispersed and arranged throughout. According to this structure, it is possible to make the sizes of the plurality of holes uniform throughout the porous resin layer. When embossing the synthetic leather, this porous resin layer can be uniformly deformed.

The porous resin layer, which is a single layer body, is formed by a process similar to the above-described Step B. In this step, a composition liquid similar to the composition liquid B is applied and this composition liquid is solidified. In the manufacturing method of the synthetic leather, the porous resin layer, which is a single layer body, is laminated on the fibrous base material 20 in the similar manner as described above. A thickness of the porous resin layer, which is a single layer body, is appropriately determined in consideration of various conditions. For example, the thickness of the porous resin layer, which is the single layer body, may be the same as the thickness of the porous resin layer 30. In the embodiment described above, the thickness of the porous resin layer 30 is the sum of the thickness T1 of the first porous resin layer 31 and the thickness T4 of the second porous resin layer 32.

(3) The porous resin layer 30 contains the plurality of hollow particles 43 in the resin that serves as the base material of the second porous resin layer 32 (see FIG. 1). The porous resin layer may contain a plurality of hollow particles in a resin that serves as a base material of a first porous resin layer (See "Sample 11" in the above-described embodiment). In this case, the hollow particle in the first porous resin layer has a first hole inside. In the porous resin layer, the plurality of hollow particles is dispersed in the resin that serves as the base material of the first porous resin layer.

Similar to the hollow particles 43 in the second porous resin layer 32, the hollow particles in the first porous resin layer may have a property of not causing volumetric expansion or hardly causing volumetric expansion by heat treatment. When manufacturing a synthetic leather, it is possible to suppress volume fluctuations of the first porous resin layer, and furthermore, it is possible to suppress variations in the shape, size, and distribution of the plurality of first holes. When embossing the synthetic leather, the first porous resin layer can be uniformly deformed together with the second porous resin layer 32.

Assume that the first hole is a closed space inside the hollow particles, and the second hole 42 is a closed space inside the hollow particle 43. In this case, the hollow particles 43 in the second porous resin layer 32 are different from the hollow particles in the first porous resin layer. That is, the porous resin layer contains a plurality of first type hollow particles in the following first resin, and contains a plurality of second type hollow particles 43 in the following second resin. The first resin serves the base material of the first porous resin layer. The second resin serves the base material of the second porous resin layer 32. The long diameter of the first hole can be the first dimension, and the long diameter of the second hole 42 can be the second dimension which is smaller than the first dimension. However, the first type of hollow particle may have specifications similar to the second type of hollow particle 43 except for the size.

DESCRIPTION OF THE REFERENCE SIGNS

10 Synthetic leather
20 Fibrous base material
30 Porous resin layer
31 First porous resin layer
32 Second porous resin layer
40 Hole
41 First hole
42 Second hole
43 Hollow particle
50 Non-porous resin layer
60 Protective layer
70 Skin material
71 Concavo-convex pattern
72 Concave portion
73 Convex portion
80 Embossing apparatus
81 Embossing die
82 Molding portion
83 Convex portion
84 Concave portion
85 Embossing receiving die

86 Heater
87 Supply device
88 Recovery device
P1, P2 Portion
T1-T10, TA, TB Thickness
T11 Total thickness
ΔT Thickness difference

The invention claimed is:

1. A synthetic leather comprising:
a fibrous base material, and
a porous resin layer laminated on the fibrous base material, the porous resin layer comprising;
a plurality of holes,
a first porous resin layer laminated on the fibrous base material; and
a second porous resin layer laminated on the first porous resin layer,
wherein the first porous resin layer has a plurality of first holes which are a part of the plurality of holes,
wherein the second porous resin layer has a plurality of second holes which are a part of the plurality of holes,
wherein the porous resin layer contains a plurality of hollow particles that are dispersed in a resin serving as a base material of the second porous resin layer,
wherein each hollow particle of the plurality of hollow particles has a respective second hole of the plurality of second holes inside.

2. The synthetic leather according to claim 1, wherein the plurality of first holes each have a closed space having a long diameter of a first dimension, and
wherein the plurality of second holes each have a closed space having a long diameter of a second dimension smaller than the first dimension.

3. The synthetic leather according to claim 1, wherein a softening temperature of the first porous resin layer is a first temperature,
wherein a softening temperature of the second porous resin layer is a second temperature lower than the first temperature.

4. The synthetic leather according to claim 2, wherein a softening temperature of the first porous resin layer is a first temperature,
wherein a softening temperature of the second porous resin layer is a second temperature lower than the first temperature.

5. A skin material comprising:
the synthetic leather according to claim 1,
wherein the synthetic leather has concavo-convex pattern on a front face.

6. A skin material comprising:
the synthetic leather according to claim 2,
wherein the synthetic leather has concavo-convex pattern on a front face.

7. A skin material comprising:
the synthetic leather according to claim 3,
wherein the synthetic leather has concavo-convex pattern on a front face.

8. A skin material comprising:
the synthetic leather according to claim 4,
wherein the synthetic leather has concavo-convex pattern on a front face.

9. The synthetic leather according to claim 1, wherein the first porous resin layer has a thickness in a range from 100 μm to 320 μm.

10. The synthetic leather according to claim 1, wherein the second porous resin layer has a thickness in a range from 20 μm to 300 μm.

* * * * *